US005857298A

United States Patent [19]

Fullwood

[11] Patent Number: 5,857,298

[45] Date of Patent: Jan. 12, 1999

[54] WINDOW FRAME SYSTEM

[76] Inventor: James Fullwood, 18163 Southeast Ridgeview Dr., Tequesta, Fla. 33469

[21] Appl. No.: 758,567

[22] Filed: Dec. 3, 1996

Related U.S. Application Data

[63] Continuation of Ser. No. 326,995, Oct. 21, 1994, abandoned, which is a continuation-in-part of Ser. No. 148,792, Oct. 29, 1993, abandoned.

[51] Int. Cl.[6] ..... E06B 3/26

[52] U.S. Cl. ..... 52/202; 52/204.62; 52/656.7

[58] Field of Search ..... 52/202, 204.597, 52/204.62, 204.67, 656.5, 656.6, 656.7, 717.01, 210

[56] References Cited

U.S. PATENT DOCUMENTS

| | | | |
|---|---|---|---|
| 3,203,053 | 8/1965 | Lane et al. . | |
| 3,919,815 | 11/1975 | Alabaster . | |
| 3,981,067 | 9/1976 | Oiler . | |
| 4,452,020 | 6/1984 | Werner | 52/202 |
| 4,599,836 | 7/1986 | Melcher | 52/202 |
| 4,630,411 | 12/1986 | Salzer . | |
| 4,685,261 | 8/1987 | Seaquist . | |
| 4,733,510 | 3/1988 | Werner | 52/202 |
| 4,753,056 | 6/1988 | Pacca | 52/202 X |
| 4,817,351 | 4/1989 | Michlovic | 52/204.597 X |
| 4,854,098 | 8/1989 | Emmer | 52/204.597 X |
| 4,866,895 | 9/1989 | Hlavaty | 52/204.597 X |
| 5,090,168 | 2/1992 | Fast et al. . | |

*Primary Examiner*—Lanna Mai
*Attorney, Agent, or Firm*—Rosenberg, Klein & Bilker

[57] ABSTRACT

A building aperture frame system including a window mounting surface and an integrally formed storm shutter mounting structure. The system may be comprised of first and second jambs, a header, and a sill, wherein the first and second jambs are vertical, the header is mounted to and traverses a distance between an upper portion of each of the first and second jambs and the sill is mounted to and traverses a distance between a bottom portion of each of the jambs. Each of the jambs has a width sufficient to traverse at least a portion of a distance between an interior and an exterior surface of a building wall defining a building aperture. Each jamb includes a mounting surface for a window unit and a shutter mounting structure for receiving a storm shutter. The storm shutter includes a shield member framed by a mounting brace wherein the mounting brace fits snugly within the shutter receiving structure.

11 Claims, 27 Drawing Sheets

WINDOW FRAME SYSTEM

This application is a continuation of patent application Ser. No. 08/326,995 filed on Oct. 21, 1994, now abandoned, which is continuation in part of a patent application Ser. No. 08/148,792 filed Oct. 29, 1993 entitled "Storm Shutter Window Frame System", now abandoned.

BACKGROUND OF THE INVENTION

A variety of systems are available to provide storm protection to openings on buildings which incorporate glass doors and windows. These protection systems range from crude plywood boards anchored to the surface of the building with nails, to electrically-operated, flexible steel shutters which can be rolled down from a storage position to cover window and door openings. Between these two extremes, there exists other types of shutter systems such as that which is disclosed in U.S. Pat. No. 4,685,261 to Seaquist.

With the exception of window protection systems which rely simply on plywood or some other material nailed to the exterior of a building construction, most storm shutters require the existence of previously-installed mounting structure to facilitate fast and efficient installation upon receiving warning of an oncoming storm. In the case of roll down steel shutters, the entire shutter is rolled inside a horizontal casing attached permanently above a window or door. In addition, for roll-down steel shutters, guide tracks must be provided along the vertical portions of the window or doorway to guide the shutter as it is rolled up and down in front of a window or door which is to be protected. Other systems, such as that which is disclosed in U.S. Pat. No. 4,685,261 to Seaquist, require pre-installed mounting brackets to facilitate quick storm shutter installation in the event of a storm warning.

One significant problem which exists concerning storm shutters is the manner in which they are installed. Since these storm protection systems are typically not part of the original design for the building on which they are installed, the methods employed for securing them to a building, are not always sufficient to withstand very high wind speeds or impact from flying debris. This is a significant problem, particularly when unskilled laborers or inexperienced homeowners are installing these storm protection devices.

Even in those instances where storm shutter systems are properly installed, they may be prone to failure as a consequence of the location in which they are mounted. Specifically, since many shutter systems are installed on the outer surface of a construction, rather than within a window or door casing, they suffer from a common problem which relates to their vulnerability in being ripped out of their mounting by wind and debris. Shutter mounting structures, which are located on the outer surface of the building rather than in a window or door casing, are prone to experience greater stress from high winds. Substructures are also vulnerable to debris impacting upon such mounting structure, as flying debris is common in hurricane-strength storms.

The present invention is designed to alleviate the problems found in shutter mounting systems of the prior art, and to provide a window frame system capable of securely maintaining a storm shutter in position without detracting from the aesthetics of a house or building. The invention is also designed to provide an inexpensive shutter mounting system which can be easily and economically incorporated into the design of a building construction.

SUMMARY OF THE INVENTION

The apparatus according to the present invention is a building aperture frame and shutter system designed to be fitted in window casings or other openings of buildings wherein storm shutters may need to be installed. The invention is comprised of first and second profiled jambs which are capable of extending along first and second vertical side walls defining a building window opening. The cross-section of the jamb, as considered from the interior side of the building aperture to the exterior side of the building aperture, is comprised of at least a mounting surface for a window unit and a spaced, integrally-formed guide channel for a storm shutter, an intermediate spacer between the mounting surface and the guide channel, and an exterior lip for receiving a building siding material may also be provided. Significantly, the interior spacer, the mounting surface, the guide channel, the intermediate spacer and the exterior lip are integrally formed as part of a single unit comprising the profiled jambs.

In addition, the invention can include a profiled header and sill capable of traversing the distance between an upper and lower portion of the first and second profiled jambs. The header, the sill and the jambs are all designed such that they may be mounted to a window or door opening in a building under construction. Similar to the jambs, the sill may be integrally formed of a sill interior spacer, a sill mounting surface for a window unit, a sill guide channel for a storm shutter, a sill intermediate spacer, and a sill exterior lip for receiving a building siding material. The header may be formed in a similar manner or, depending upon the storm shutter system to be used, may be formed as a housing for a roll-up type storm shutter.

In a preferred embodiment, the guide channel is free of obstructing structure outwardly in the direction of the exterior face and in the direction of the area between the first and second profiled jambs. Each portion of the guide channel in the first and second profiled jambs receives an opposite edge of the shutter when the shutter is installed. The system includes at least one fastener to maintain the shutter in a mounted position.

Thus, one object of the invention is to provide a shutter system wherein a single frame provides an integrally formed shutter mounting structure and a window unit mounting surface. By providing a single integral shutter and window frame, superior strength characteristics result. For example, additional structural support is provided to the receiving alcove by the window unit itself. A window unit as referred to herein includes an independent frame for supporting glass panels. Thus, a window unit mounted within the shutter frame, according to the present invention, internally braces the frame system, including the integrally formed receiving alcove.

In addition, the wider mounting surface defined by the jambs provides a larger area for locating mounting bolts than would typically be possible for a separate mounted shutter guide. This permits stronger mounting and a more stable base.

Also, in a preferred system, the first and second profiled jambs, the header, and the sill, are all constructed so as to have the same cross section.

Thus, another object of the present invention is to provide a versatile window framing configuration which can be used as either a header, a sill, or a lateral jamb. By providing a single versatile configuration, the cost of manufacturing an entire window/shutter frame system is minimized.

The shutter may include a shield member and a mounting brace that frames the shield member. When installed, the mounting brace should be received in the guide channel.

Yet another object of the present invention is to provide a shutter system including a mounting brace that circumscribes the shield portion of the shutter. The mounting brace serves a number of important purposes. First, the mounting brace offers support to the shield member. While the shield member might consist of a heavy metal plate that could withstand high winds and the impact of airborne debris, cost and installation considerations often render such a design impractical. Instead, shield members are normally constructed of either plywood or relatively thin corrugated sheet metal. The mounting brace provides a skeletal form for the shield member thus making the shutter as a whole much stronger.

Other and further aspects and objects of the present invention will become apparent during the course of the following description and by reference to the accompanying drawings.

DETAILED DESCRIPTION OF THE PREFERRED EMBODIMENT

Figure 1:
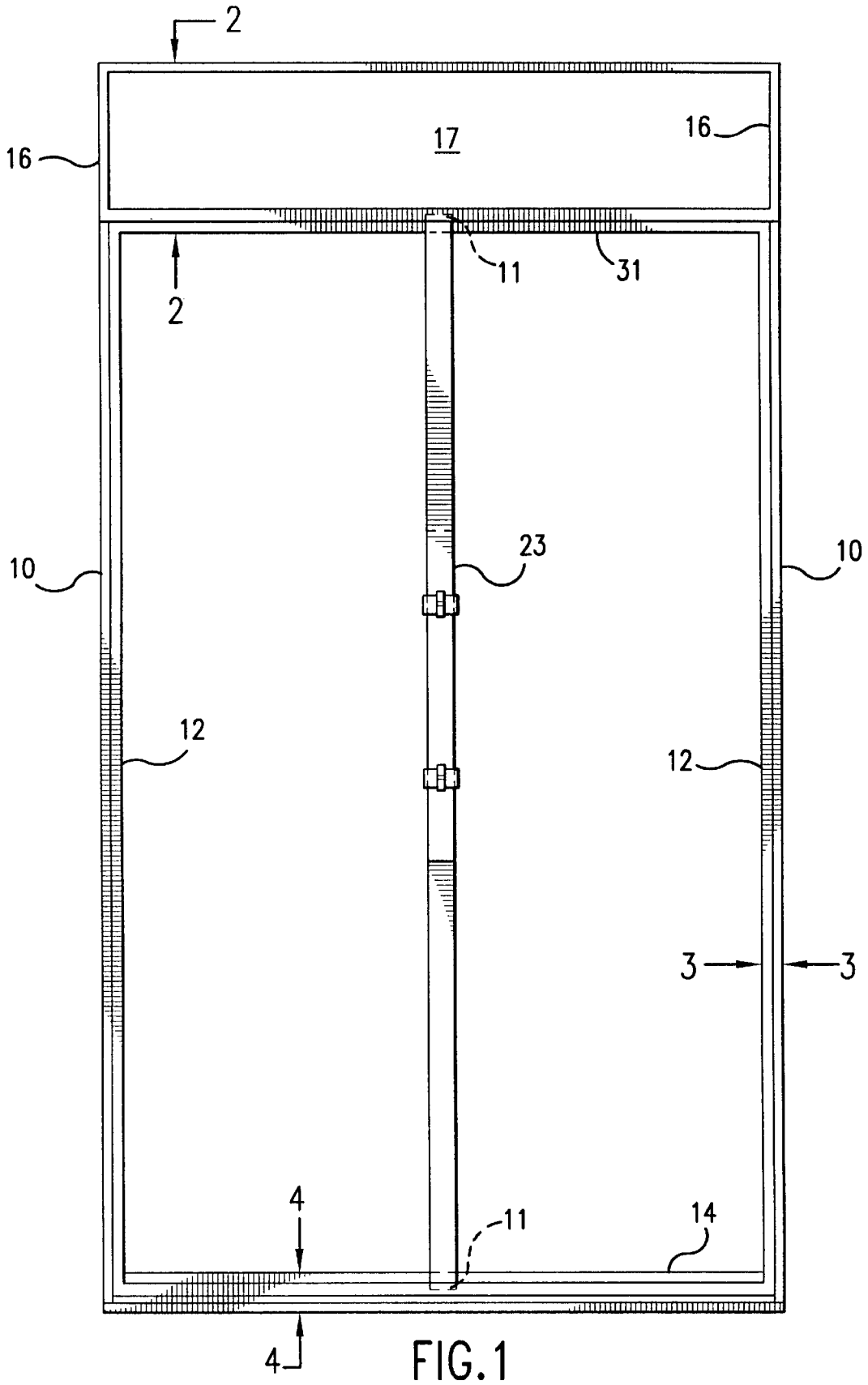
FIG. 1 is an elevation view of a first embodiment of a building aperture frame system according to the present invention.

This invention relates to a window frame system for buildings and, in particular, relates to a window frame system capable of accommodating a storm shutter. As shown in FIGS. 1–6 the system according to a first embodiment is comprised of an outer frame 10 which can be formed from profiled jambs 12, a profiled sill 14 and a shutter housing 16. Profiled jambs 12 and profiled sill 14 are preferably mitred at the corners where they meet to form part of a rectangular frame as shown in FIG. 1. Shutter housing 16 is mounted to profiled jambs 12 at their upper ends.

The particular configuration of profiled jambs 12 and sill 14 shown in FIGS. 1–7 are designed for use with an 8" thick, concrete block wall. Significantly, however, the invention is not so limited, and other configurations are possible.

Figure 3:
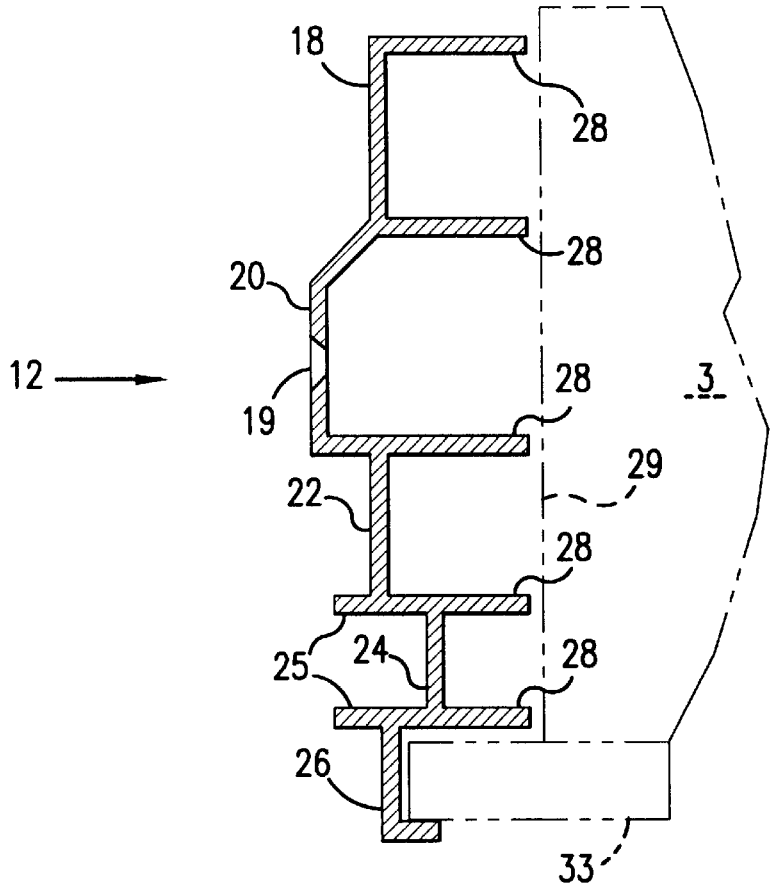
FIG. 3 is a cross-sectional view along lines 3—3 in FIG. 1.

As shown in FIG. 3, jambs 12 are preferably formed from an extruded material and have a profiled cross-section. One jamb 12 will have the orientation shown in FIG. 3 while the other jamb will have the reverse configuration to accommodate its placement on the opposite side of the frame system.

The profiled jamb 12 is comprised of several distinct portions, each performing a specific function. In particular, the jamb preferably includes an interior spacer 18, a window mounting surface 20, an intermediate spacer 22, a guide channel 24 and an exterior lip 26. Various other jamb configurations are possible. However, the jamb should at least provide an integrally formed window mounting surface 20 and an integrally formed guide channel 24.

The guide channel 24, according to the present invention, is preferably formed from a U-shaped portion of profiled jamb 12 defined by two guide walls 25. Exterior lip 26 is comprised of an extension plate projecting outwardly from the guide channel 24, in a direction substantially perpendicular to guide wall 25. A flange portion of said exterior lip 26 projects outwardly from said extension plate away from the building aperture. Intermediate spacer 22 is preferably provided to provide clearance between components comprising a window unit and a shutter plane, defined by said guide channels 24.

On the rear surface of the jamb 12 are provided support legs 28. Jamb 12 is designed to be mounted such that support legs 28 engage the surface of a building aperture along a vertical side wall of said aperture. For the purpose of this description, the vertical side wall is understood to mean the portion of the building wall traversing the distance between the interior and exterior surfaces of the wall along a vertical portion of the building aperture.

Figure 4:
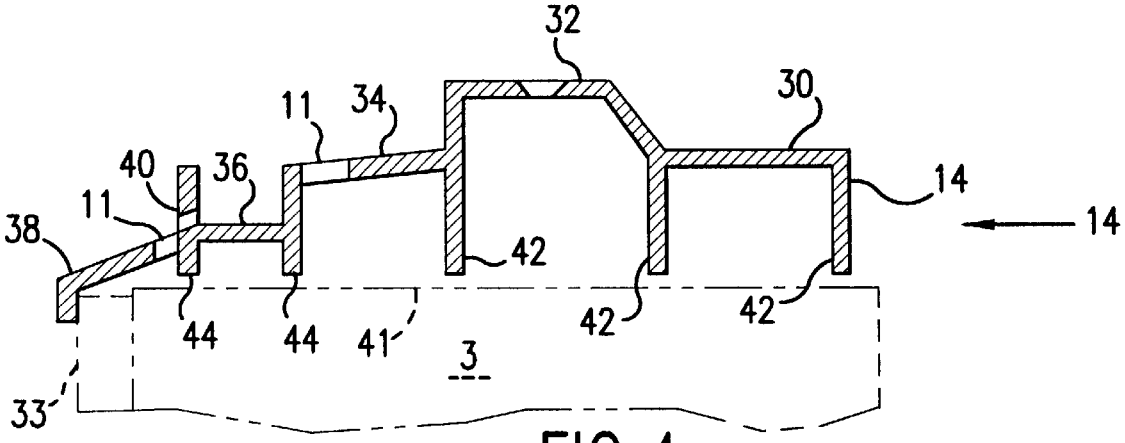
FIG. 4 is a cross-sectional view along lines 4—4 in FIG. 1.

As shown in FIG. 4, the profiled sill 14 is similar to profiled jamb 12 in that it preferably incorporates a sill interior spacer 30, a sill mounting surface 32, a sill intermediate spacer 34, a sill guide channel 36 and a sill exterior lip 38. As noted above, however, the precise configuration of the profiled sill can vary substantially, so long as a window mounting surface is provided, as well as a spaced sill guide channel. A weep hole 40 can be provided at the base of sill guide channel 36 to allow accumulated water to drain.

The sill exterior lip 38 is preferably comprised of a downwardly-angled drip plat extending outwardly from said building aperture along a lower portion of the sill guide channel 36. The exterior lip 38 can be further comprised of a flange portion extending downwardly away from the drip plate. When formed in this manner, the sill exterior lip is adapted to receive a building siding material in the channel formed by the angled drip plate and the flange portion.

Sill support legs 42 and support nubs 44 are provided on the rear surface of the profiled sill for engaging a sill support wall traversing the distance between the interior and exterior portions of a window aperture along its base. Profiled jambs 12 and profiled sill 14, are preferably designed such that the interior spacer, mounting surface, intermediate spacer and guide channel of each unit align with one another when the frame system is constructed and installed.

Figure 2:
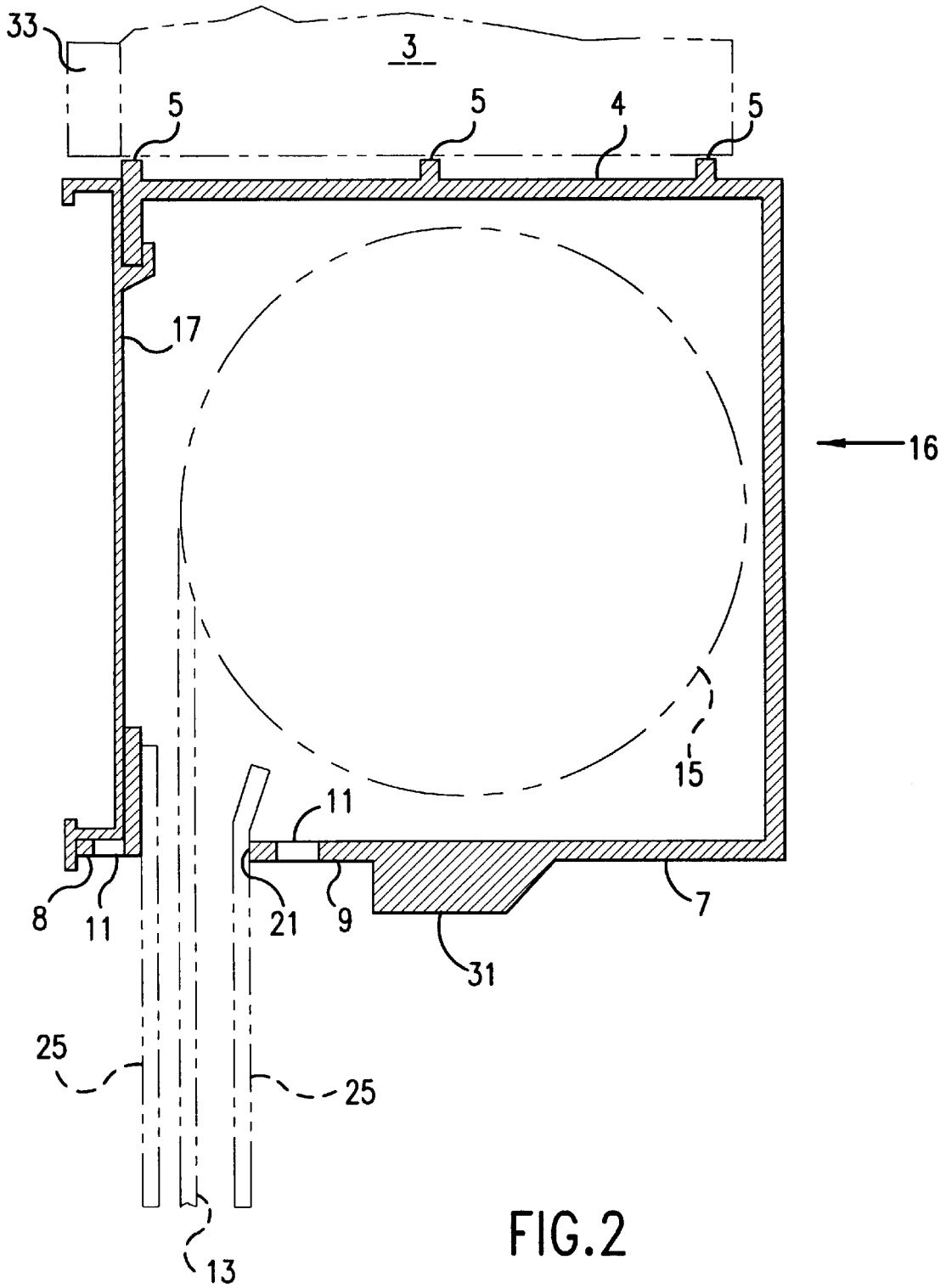
FIG. 2 is a cross-sectional view along lines 2—2 in FIG. 1.

As shown in FIG. 2, when a roll shutter 15 encased within shutter housing 16 is manually or automatically deployed, leading edge 13 of roll shutter 15 can be guided downwardly along jamb guide walls 25 forming guide channels 24 in jambs 12. When completely extended, roll shutter leading edge 13 will preferably engage sill guide channel 36 and can thereafter be locked in that position. Shutter housing 16 is preferably mounted between an upper portion of jambs 12, such that a shutter deployment slot is aligned with jamb guide channels 24.

Figure 5:
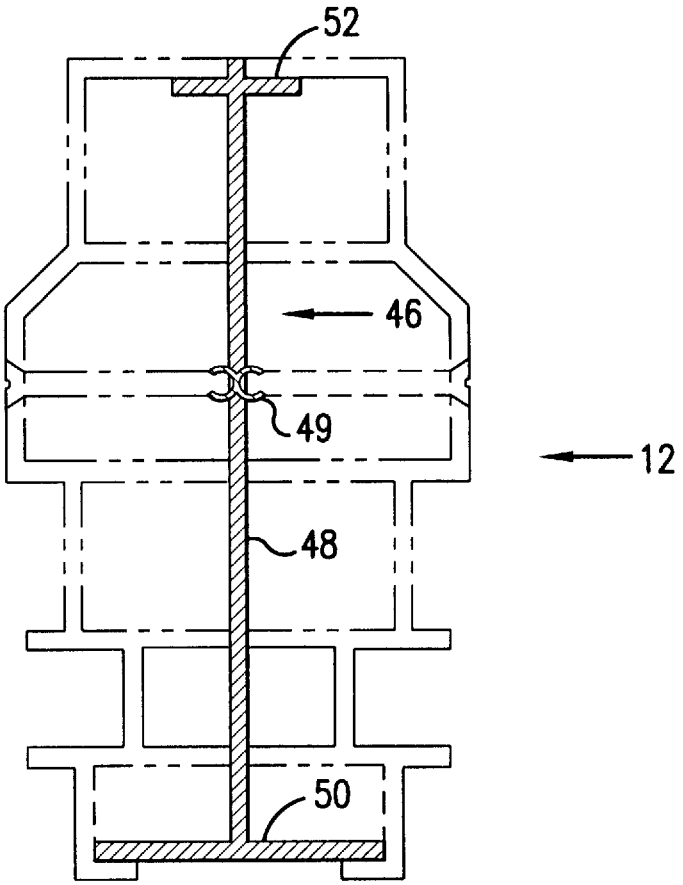
FIG. 5 is a cross-sectional view of a tee mullion for mounting a plurality of the frame systems shown in FIG. 1, side by side.

As shown in FIG. 5, jambs 12 can be provided with lock bar apertures 11 formed in intermediate spacers 22 at selected locations along the vertical height of the jambs 12. Lock bar apertures 11 are designed for receiving an adjustable length lock bar 23 for supporting a rear surface of a storm shutter to prevent it from collapsing toward the interior space of a building construction. In addition, lock bar apertures 9 can be provided along exterior lip 26 for receiving additional lock bars 23 on the outer surface of storm shutters.

According to the present invention, the frame system shown in FIGS. 1–6 can be mounted in a window or doorway aperture by any appropriate means such as bolts or screws passing through the jambs 12 and sill 14. Once mounted in this position, the frame system provides a window or door unit mounting surface 20. More importantly, however, the frame system also provides an integrated roll up shutter guide system having superior strength characteristics as compared to shutter guide systems of the prior art.

The superior strength characteristics of the present frame system results from several factors. One important factor stems from the additional structural support provided to the shutter guide by the window or glass door unit itself. A window or glass door unit as referred to herein includes an independent frame for supporting glass panels. Thus, a window or glass door unit mounted within the shutter frame, according to the present invention, internally braces the frame system, including the integrally formed shutter guides. In addition, the wider mounting surface defined by the profiled jambs 12 and profiled sill 14 provide a larger area for locating mounting bolts than would typically be possible for a separately mounted shutter guide. This permits stronger mounting and a more stable base.

Finally, utilizing a frame system according to the present invention simplifies building construction and results in an improved appearance. Construction is simplified because a builder can avoid the additional step of installing and aligning independent shutter guide channels. Appearance, however, is also improved since the shutter guides can be more smoothly integrated with the outer siding of a building which is being constructed.

In a preferred embodiment, the frame system according to the present invention can be installed in a building aperture such that support leg 28 mounted to the edge of interior spacer 18 is aligned flush with the interior surface of an unfinished building wall. Support leg 28 adjacent to exterior lip 26 is preferably aligned with, or set slightly back from, the exterior surface of an unsided wall of the building under construction. When mounted in this manner, exterior lip 26 of jamb 12 provides a pocket into which a siding material such as cement or plaster may be filled so that the siding can be aligned with, or recessed slightly behind, the exterior edge of the jamb.

Profiled sill 14 is preferably mounted in a similar manner to jamb 12 so that support leg 42 on the innermost side of sill interior spacer 30 is approximately aligned with the interior surface of the wall under construction. Like the jamb, when the sill is installed in this manner, the exterior lip 38 will protrude slightly beyond the surface of an unfinished concrete block wall. Here again, the sill exterior lip is provided such that when an exterior cement or plaster finish is applied to the concrete wall, the exterior finish will fill in the area of the sill lip, so that it is slightly recessed behind the edge of the sill.

Figure 6:
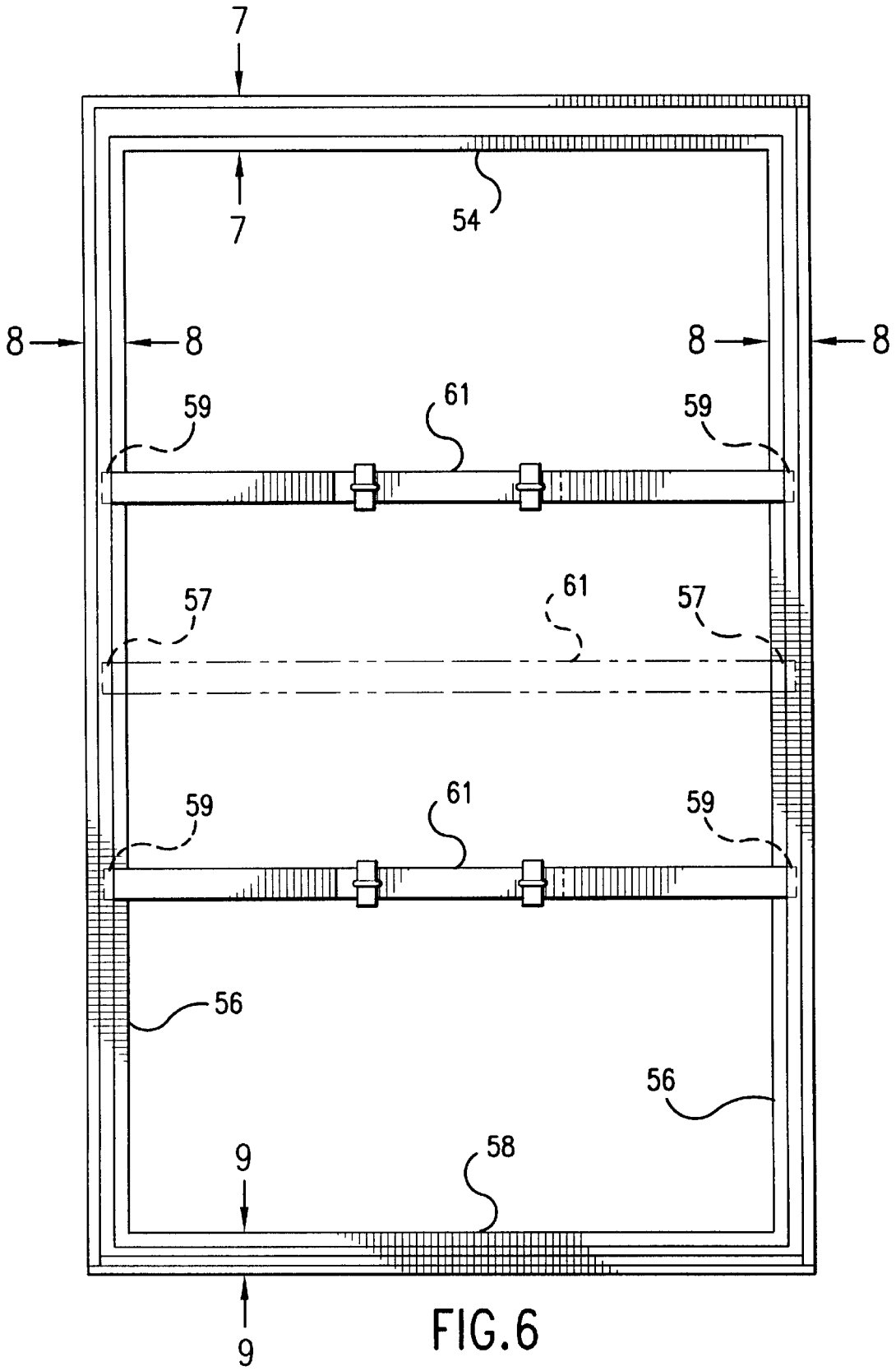
FIG. 6 is an elevation view of a second embodiment of a frame system according to the present invention, with lock bars in place.

FIG. 6 shows a tee mullion 46 for use in aligning and supporting, side by side, a plurality of aperture frame systems of the type shown in FIG. 1. Tee mullion 46 is comprised of a primary member 48, main cross-member 50 and secondary cross-member 52. When it is desired to mount window frames according to the present invention adjacent to one another, support legs 28 of adjacent jambs 12 will engage the surface of primary member 48. Main cross-member 50 serves to support the exterior lip 26 portions of the jambs 12 and also fills in the space which would normally be filled by an exterior siding such as cement or plaster. Secondary cross-member 52 is provided to help maintain adjacent jambs 12 in proper position with respect to one another.

A second embodiment according to the present invention is shown in FIGS. 7–11. In this embodiment, the frame system is not designed for operation with a roll up shutter. Instead, an integrated mounting system is provided for storm shutters which may be physically placed in the window frame upon warning of an approaching storm. As with the previous embodiment, the profiled parts of the frame system in FIGS. 7–11 are designed for an 8" thick concrete block wall. However, the invention again is not limited in this regard, and various other configurations are possible.

Figure 7:
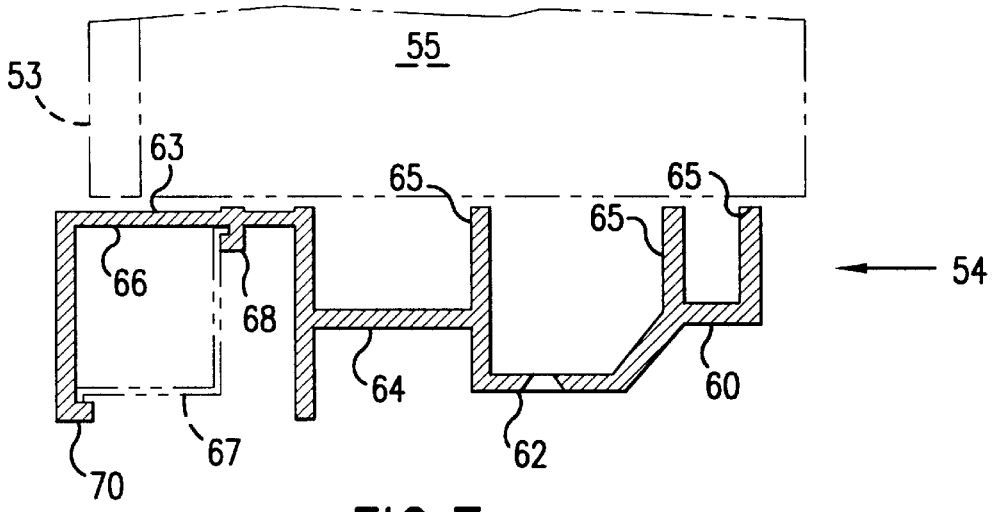
FIG. 7 is a cross-sectional view along line 7—7 in FIG. 6.

As shown in FIG. 7, the window frame is comprised of a profiled head 54, profiled jambs 56 and a profiled sill 58. Sill 58, jambs 56 and head 54 are preferably mitred at their ends to form a continuous outer frame 51.

Figure 8:
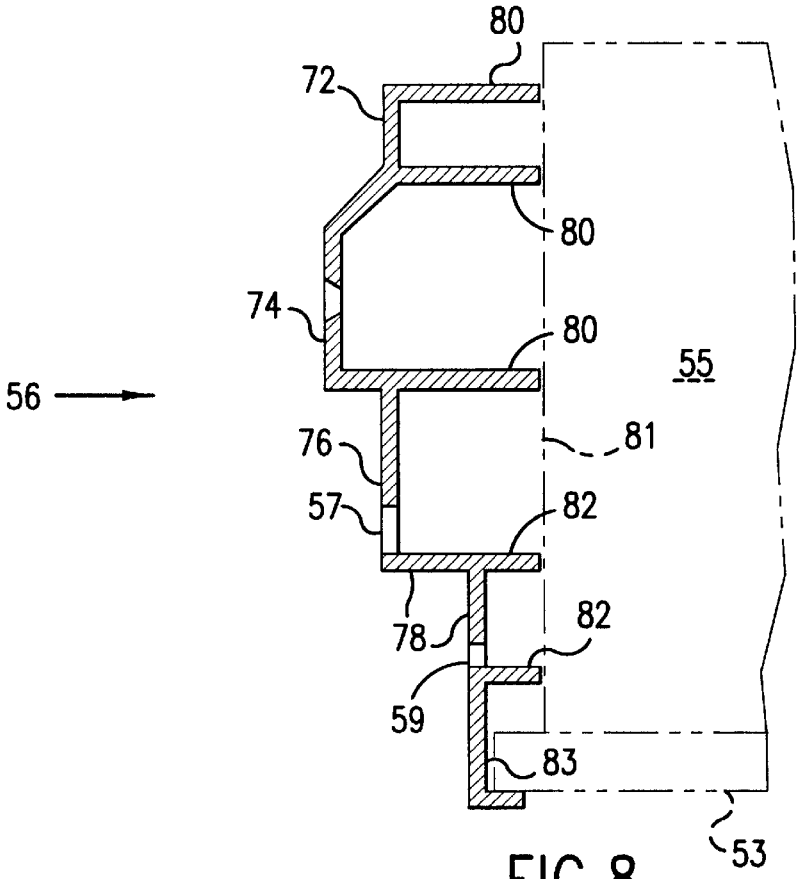
FIG. 8 is a cross-sectional view along line 8—8 in FIG. 6.

FIG. 8 shows a cross-sectional view of profiled head 54. Profiled head 54 can be comprised of an interior spacer 60, a mounting surface 62, an intermediate spacer 64 and a guide channel 66. Guide channel 66 is preferably provided with locking tabs 68 and 70.

Head locking tabs 68 and 70 are provided for receiving a spring clip 67 as shown in FIG. 8. The purpose of clip 67 is to decrease the width of head guide channel 66 in cases where the material from which the storm shutters is formed has a thickness of less than the entire guide channel 66. In effect, spring clip 67 is a removable spacer mechanism.

On the rear surface of the profiled head 54, support legs 65 are provided to engage the upper portion of a building wall traversing the distance between the interior and exterior surfaces of a building wall through the aperture. Finally, an exterior lip 63 is defined on a portion of said header defining a rear surface of said guide channel base.

Figure 9:
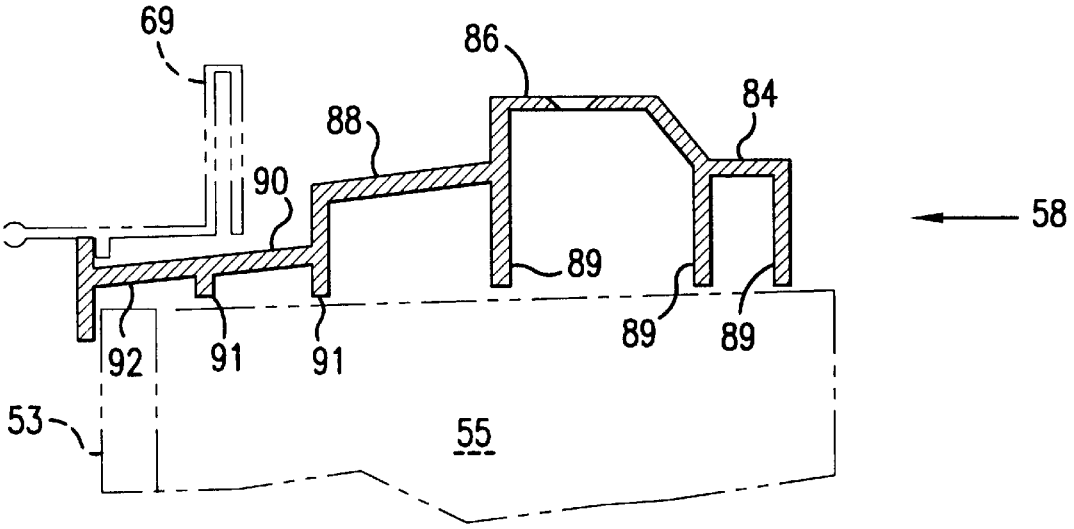
FIG. 9 is a cross-sectional view along line 9—9 in FIG. 6.

FIG. 9 shows a cross-sectional view of profiled jamb 56. Similar to profiled head 54, profiled jamb 56 can incorporate a jamb interior spacer 72, a jamb mounting surface 74, a jamb intermediate spacer 76 and an L-shaped mounting brace 78 for receiving a storm shutter. Support legs 80 and support nubs 82 are also provided. The jamb 56 located on the opposite side of the frame system will have the reverse orientation of the frame shown in FIG. 9 to accommodate its placement. Jambs 56 are designed to be mounted such that the support legs 80 and support nubs 82 engage the surface of a vertical side wall of a building aperture traversing the distance between the interior and exterior surfaces of the building wall. Exterior lip 83 is provided to extend the jamb slightly beyond the surface of an unsided building wall.

Figure 10:
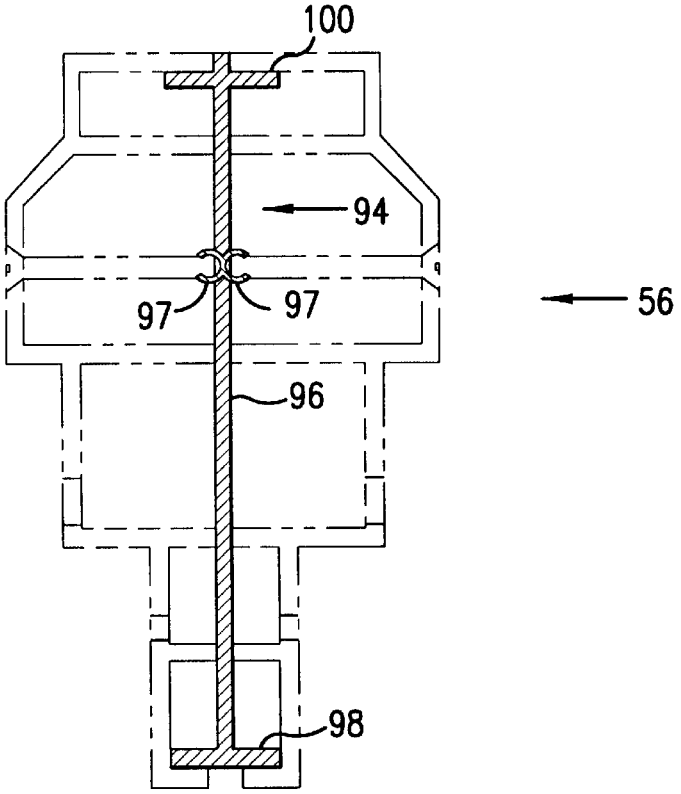
FIG. 10 is a cross-sectional view of a tee mullion for mounting a plurality of the frames shown in FIG. 6, side by side.

FIG. 10 shows the profiled sill 58 of outer frame 51 in cross-section. The profiled sill 58 is preferably comprised of a sill interior spacer 84, a sill mounting surface 86, a sill intermediate spacer 88 and a shutter mount channel 90. A sill exterior lip 92 is provided to extend the sill slightly beyond the surface of an unfinished building wall. Support legs 89 and support nubs 91 are also provided as shown.

The profiled head 54, profiled jambs 56 and profiled sill 58 are preferably designed such that the interior spacer 60, 72, 84, mounting surface 62, 74 86, and intermediate spacer 64, 76, 88 of each of these components align with one another when the frame system is assembled. As previously explained, the precise configuration of the profiled jambs, sill and header can be varied so long as a window mounting surface is provided spaced apart from an integrally formed storm shutter mounting structure.

The frame system is preferably installed such that the edge of interior spacer 60, 72 and 84 is aligned with the interior surface of an unfinished building wall. When mounted in this fashion, the profiled head 54, jambs 56 and sill 58 will protrude slightly beyond the unfinished exterior surface of the wall. Thus, as with the previously described embodiments, the window frame provides an exterior lip 63, 83, 92 into which may be filled an exterior siding finish such as cement or plaster. When a siding is applied in this manner, the building wall exterior surface will be slightly recessed behind the outer edge exterior lip 63, 83, 92.

When installed as described above and bolted in place, the frame system according to the present invention provides a convenient and strong mounting system for removable storm shutters. Specifically, a storm shutter manufactured from corrugated steel or plywood can be provided to approximately fit the outline defined by the head guide channel 66, the jamb mounting braces 78 and the sill mounting channel 90. The panel is preferably sized so that it may be inserted in head guide channel 66 with sufficient clearance to pass over an upper portion of sill exterior lip 92 and thereafter be downwardly displaced to rest in sill mounting channel 90. As shown in FIG. 8, a spring clip spacer 67 may be inserted in locking tabs for thinner types of shutter material.

As shown in FIG. 7, jambs 56 can be provided with lock bar apertures 57 formed in intermediate spacers 76 at selected locations along the vertical height of the jambs. Lock bar apertures 57 are designed to receive an adjustable length lock bar 61. Adjustable length lock bars 61 provide support to a rear surface of a storm shutter to prevent it from collapsing inwardly toward the interior space of a building construction. In addition, lock bar apertures 59 can be provided along L-shaped mounting brace 78 for receiving additional lock bars 61 on the outer service of storm shutters after they have been positioned within the frame system.

According to the present invention, the frame system shown in FIGS. 7–12 can be mounted in a window opening by any suitable means such as bolts or screws. Once mounted in this position, the frame system provides a window mounting surface 74, 62, 86. More importantly, however, the frame system also provides an integrated mounting location for storm shutters, which mounting system has superior strength characteristics as compared to mounting systems of the prior art.

As with the previously described embodiment, the superior strength characteristics of the present frame system results from several factors. One such factor stems from the additional structural support provided to the shutter guide by the window or a glass door unit installed within the frame system. A window or door unit, according to the present invention, has an independent frame system for positioning a glass pane. The independent frame mounted within the frame system of the present invention internally braces the frame system, and therefore provides additional structural support to the integrally formed shutter mounting structure. In addition, the wider mounting surface defined by the profiled jambs 56, profiled head 54 and profiled sill 58 provide a larger area for locating mounting bolts as compared to that which would be available for a storm shutter mounting system which was not incorporated into the present frame system.

Finally, utilizing a frame system as described in the present embodiment simplifies building construction in the same manner as described in the previous embodiment.

Construction is simplified because a builder can avoid the additional steps of installing and aligning independent shutter mounting hardware. Appearance is also improved since there is no need for installation of an additional shutter mounting structure.

The frame system shown in FIG. 7 is preferably installed in a building aperture such that support legs 65, 80 and 89, associated with the edge of the interior spacer, are aligned approximately flush with the interior surface of an unfinished building wall. When mounted in this manner, the profiled head 54, sill 58 and jambs 56, and in particular, exterior lips 63, 83 and 92 will protrude slightly beyond the exterior surface of an unfinished concrete block wall. The protrusion of the profiled jamb, sill and head are provided such that when an exterior cement or plaster finish is applied to the concrete wall, the exterior surface will be flush or slightly recessed from the outer edge of the frame system defined by said exterior lips.

Figure 11:
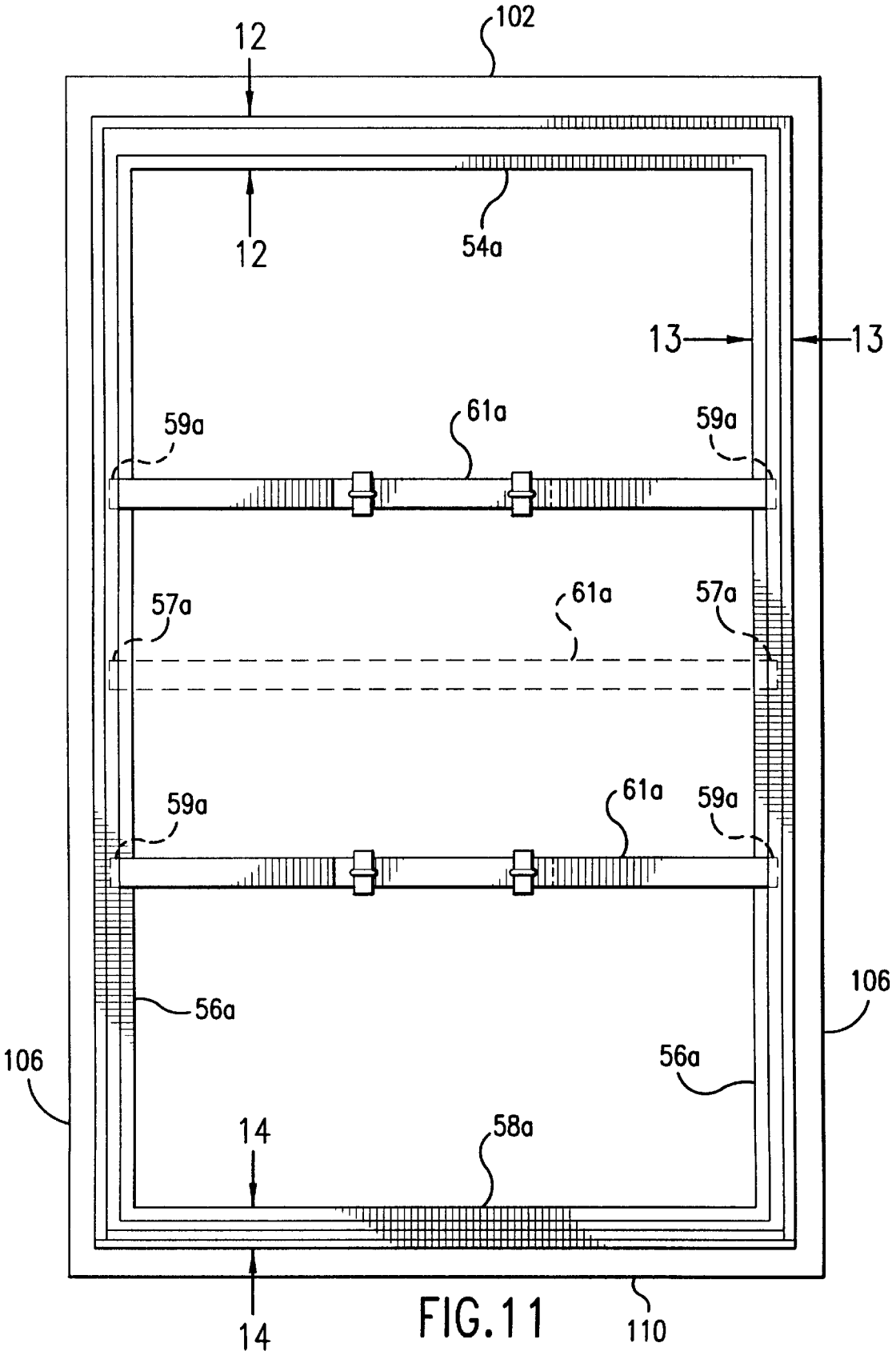
FIG. 11 is an elevation view of a window frame system according to a third embodiment of the present invention.

FIG. 11 shows a tee mullion 94 for use in aligning and supporting, side by side, a plurality of aperture frame systems of the type shown in FIG. 7. Tee mullion 94 is comprised of a primary member 96, a main cross-member 98 and a secondary cross-member 100. When it is desired to mount window frames according to the present embodiment adjacent to one another, support legs 80 and support nubs 82 of adjacent profiled jambs 56 will engage the surface of primary member 96 as shown in FIG. 11. Main cross-member 98 serves to support the outermost portion of the L-shaped mounting brace 78 and also fills in the space which would normally be filled by an exterior siding such as cement or plaster. Secondary cross-member 100 is provided to help maintain adjacent jambs 56 in position with respect to one another.

The third and fourth embodiments of the present invention shown in FIGS. 12–16 and 17–21 are generally similar to the embodiments shown in FIGS. 7–11. However, the embodiment in FIGS. 12–16 is designed for use with a 6" stud wall, and the embodiment in FIGS. 17–21 is designed for use with a 4" stud wall. Corresponding components of each of these embodiments have been referenced using the same numbers as in FIGS. 7–11, with the suffix a and b added, respectively.

Figure 12:
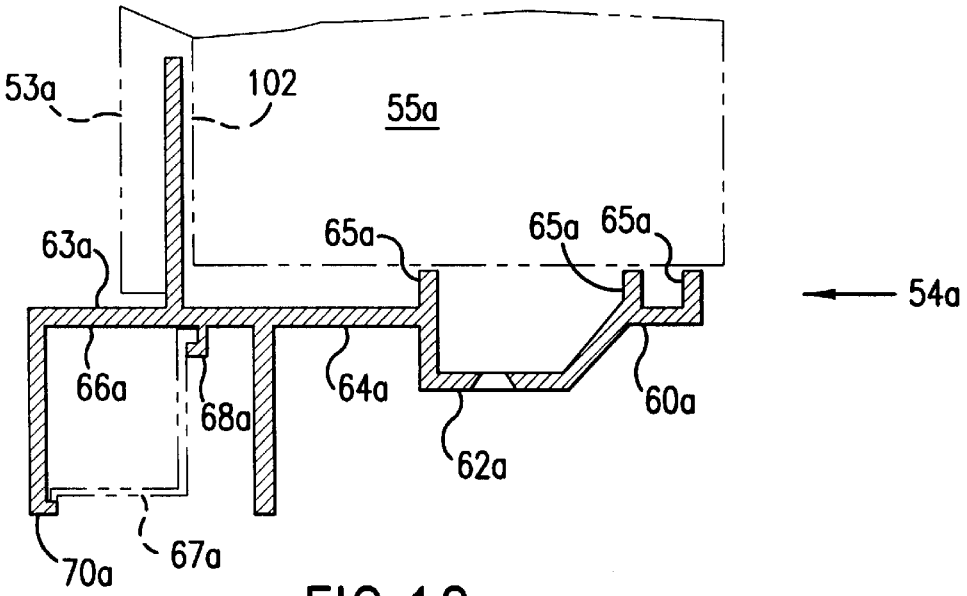
FIG. 12 is a cross-sectional view along lines 12—12 in FIG. 11.
Figure 13:
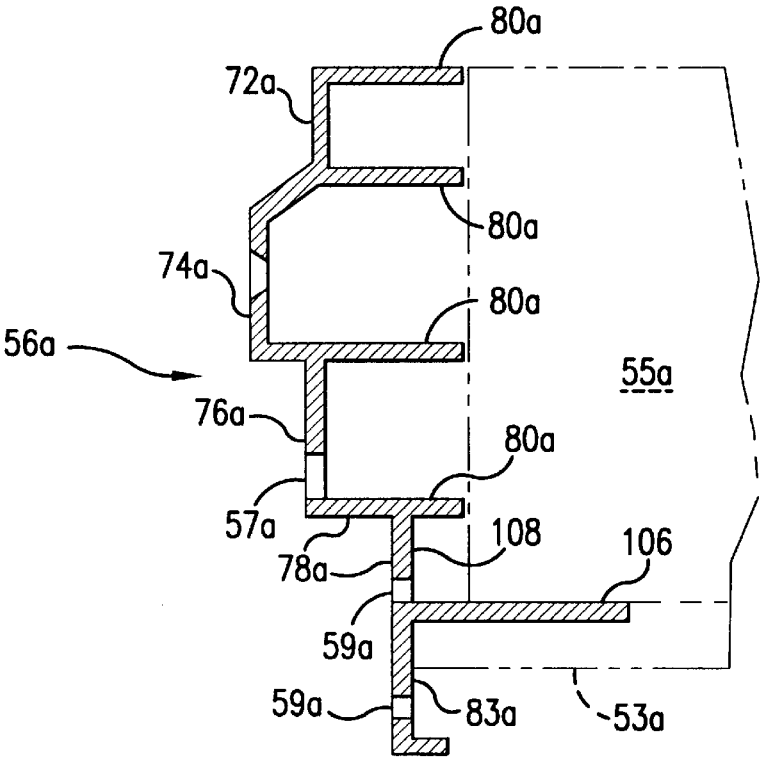
FIG. 13 is a cross-sectional view along lines 13—13 in FIG. 11.
Figure 14:
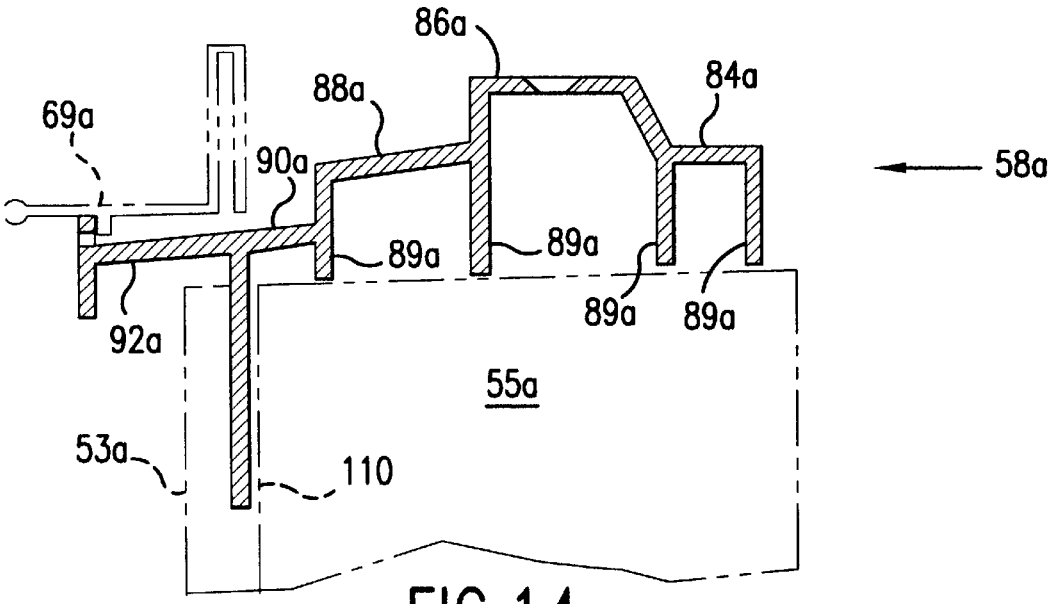
FIG. 14 is a cross-sectional view along lines 14—14 in FIG. 11.
Figure 15:
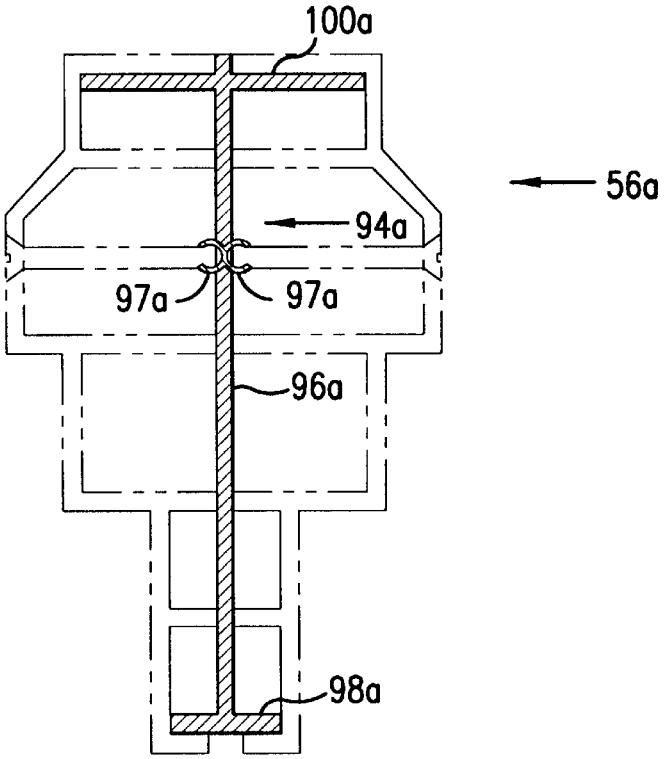
FIG. 15 is a cross-sectional view of a tee mullion for mounting a plurality of the frame systems shown in FIG. 11, side by side.

As noted above, the building aperture frame system shown in FIGS. 12–16 is designed for use in connection with a 6" stud wall. To accommodate the decreased wall thickness, the profiled head 54*a*, profiled jamb 56*a* and profiled sill 58*a* are formed with a slightly different configuration as compared to the embodiments shown in FIGS. 7–11. Most significantly, exterior surface plates 102, 106, 110 in FIGS. 13–15 are provided on profiled head 54*a*, profiled jamb 56*a* and profiled sill 58*a*, respectively, for positioning the frame system in the building aperture. When placed along the exterior wall surface of a building aperture wherein 6" stud wall construction is used, exterior surface plates 102, 106, 110 will engage the unfinished exterior surface of a wall. This will position the frame system such that interior-most support leg 65*a*, 80*a*, 89*a* will be positioned approximately adjacent to the unfinished interior surface of the wall surrounding the aperture.

As with the previous embodiment, head locking tabs 68*a* and 70*a* in FIG. 13 are provided in channel 66*a*. The purpose of said tabs is for receiving a spring clip 67*a* in the event that head guide channel 66*a* is too wide to receive the particular type of material from which a storm shutter is formed. Here again, spring clip 67*a* essentially acts as a removable spacer mechanism for storm shutters of lesser thickness. After the frame system is installed, a siding finish is preferably applied on the exterior surface of the building wall surrounding the frame system. The siding finish is preferably applied so as to fill in the area around exterior lip surfaces 63*a*, 83*a*, 92*a*, 108, 112. In this manner, the exterior siding surface will appear to be slightly recessed behind the outermost edge of the frame system.

As with the previously described embodiments, the frame system according to the embodiment shown in FIGS. 12–16 should be constructed such that the various interior spacers 60*a*, 72*a* and 84*a*, mounting surfaces 62*a*, 74*a* and 86*a*, intermediate spacers 64*a*, 76*a* and 88*a* are, respectively, in alignment with one another. Likewise, head guide channel 66*a* should be substantially in alignment with L-shape mounting brace 78*a* and sill mounting channel 90*a* for receiving a storm shutter.

Figure 16:
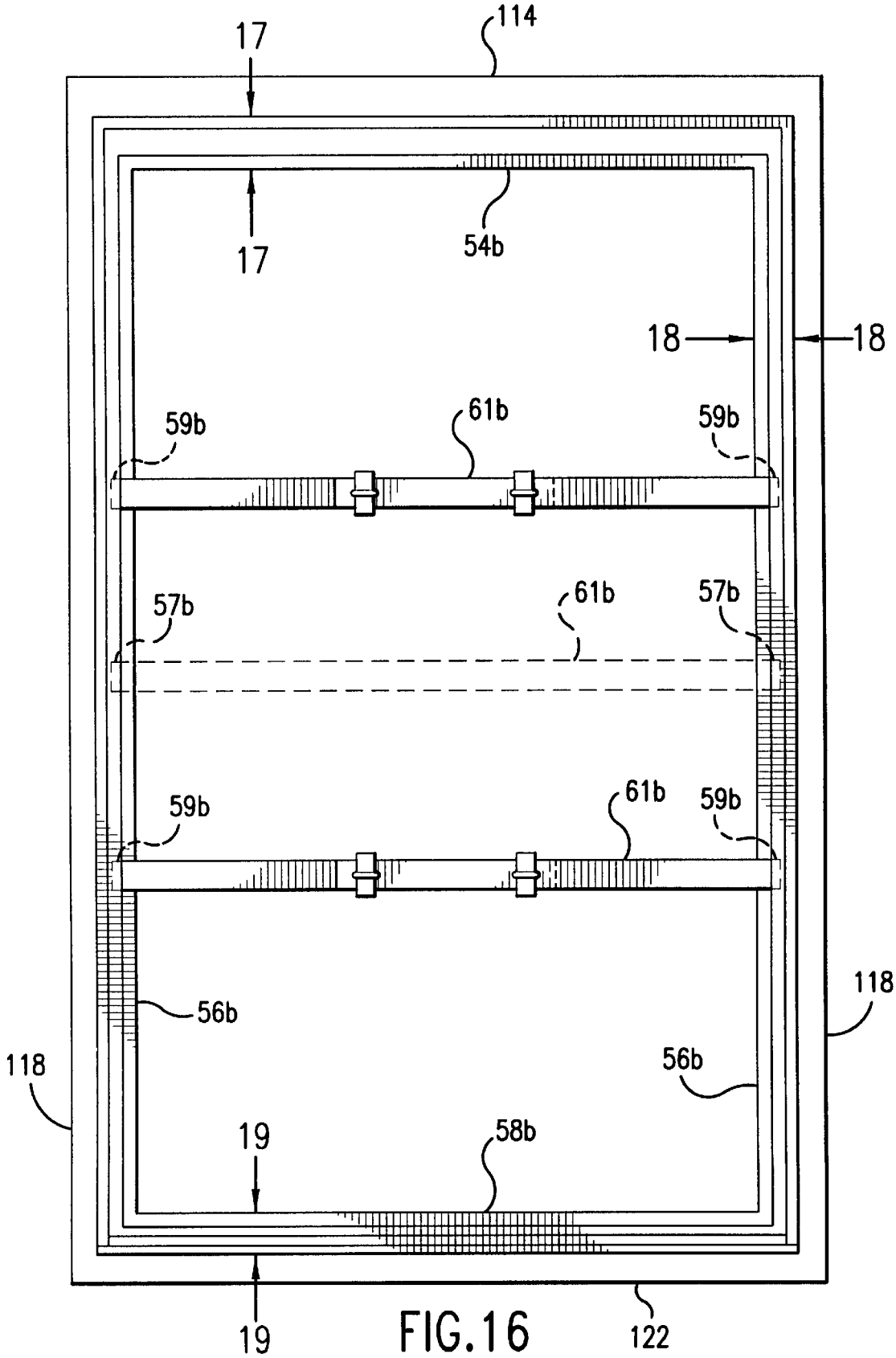
FIG. 16 is an elevation view of a fourth embodiment according to the present invention.
Figure 17:
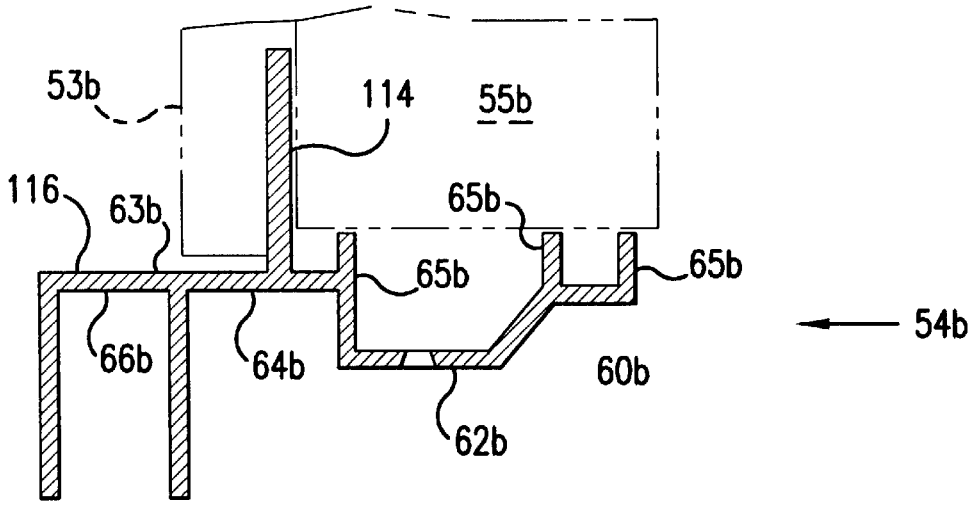
FIG. 17 is a cross-sectional view along line 17—17 in FIG. 16.

FIG. 16 shows a tee mullion 94*a* to facilitate mounting a plurality of frame systems according to the present embodiment adjacent to one another in a building aperture. Similar to the previous embodiments, tee mullion 94*a* is comprised of a primary member 96*a*, a main cross-member 98*a* and a secondary cross-member 100*a*. Finally, as shown in FIG. 12, apertures 57*a* and 59*a* can be provided respectively in the interior spacer 76*a* and along L-shaped mounting brace 78*a* for receiving adjustable length lock bars 61. The lock bars brace the interior and exterior surface of a storm shutter installed in the frame system.

Figure 18:
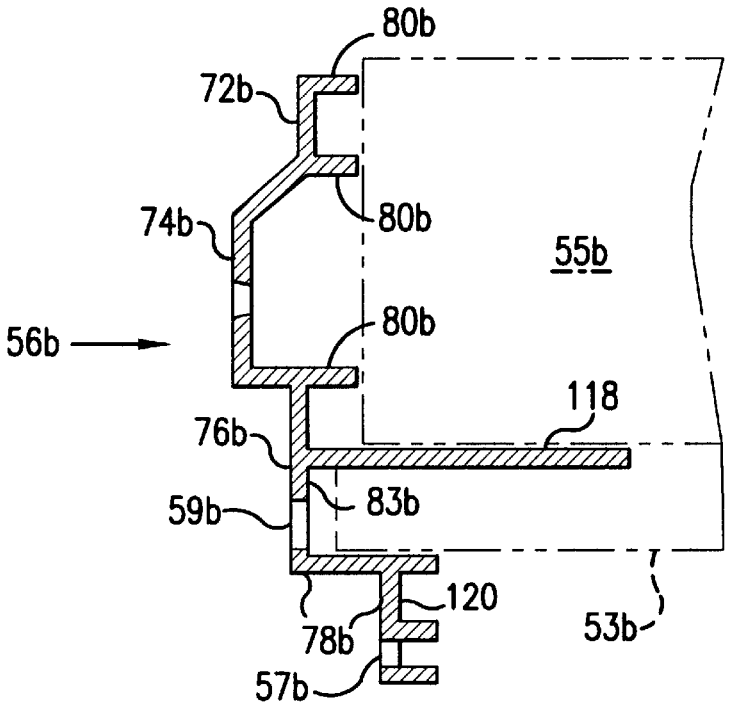
FIG. 18 is a cross-sectional view along lines 18—18 in FIG. 16.
Figure 19:
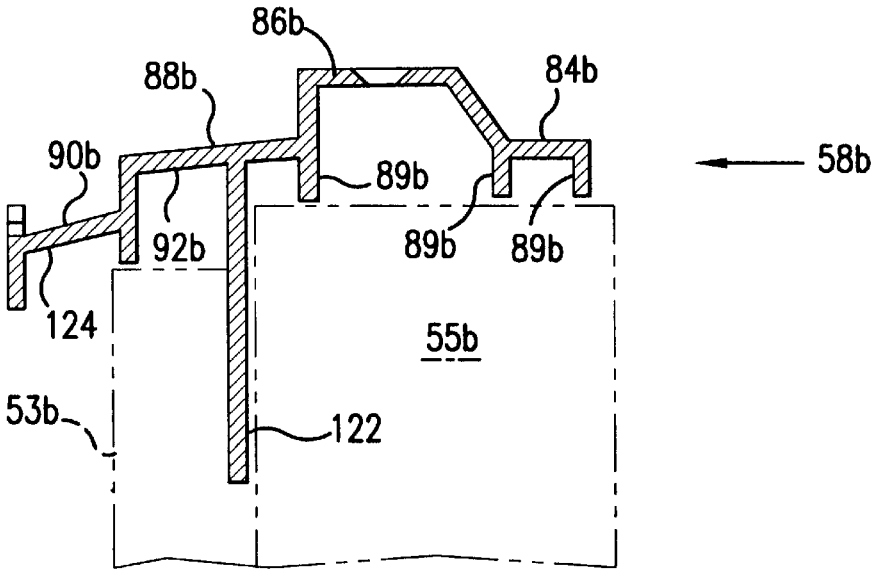
FIG. 19 is a cross-sectional view along line 19—19 in FIG. 16.
Figure 20:
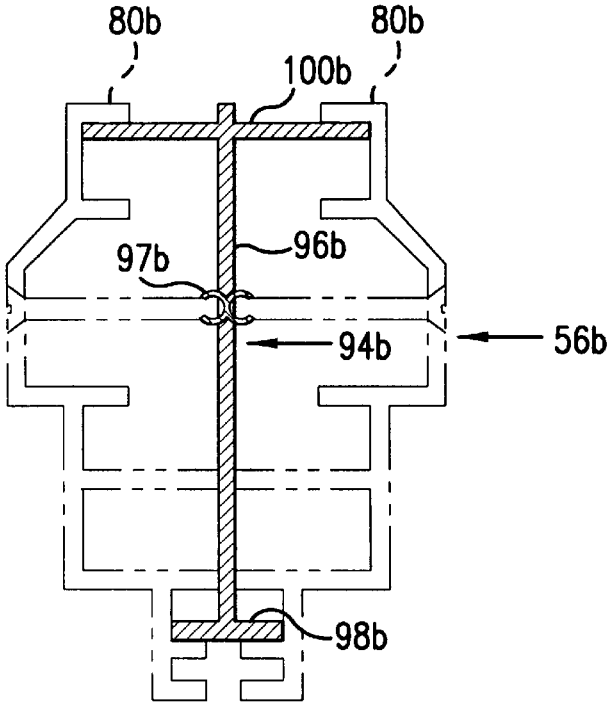
FIG. 20 is a cross-section of a tee mullion for mounting a plurality of window frame systems as shown in FIG. 16, side by side.

FIGS. 17–21 show a fourth embodiment according to the present invention designed for use with a 4" stud wall construction. As shown in FIGS. 18, 19 and 20, exterior surface plates 114, 118 and 122 are provided for engaging the unfinished exterior surface of a building wall surrounding an aperture into which the frame is to be installed. As with the previously described embodiment, when the frame system is installed in this manner, support legs 65*b*, 80*b*, 89*b* adjacent to the edge of said runner spacer will be positioned adjacent to an unfinished interior wall surface. An exterior siding surface is preferably applied over exterior surface plates 114, 118 and 122 such that exterior lips 63*b*, 80*b*, 92*b* are filled with said exterior finish. If desired, a further finishing detail surface can be applied to build up the wall surface in the area surrounding the frame system such that the exterior siding material also fills detail lip 116, 120, 124 in FIGS. 18, 19 and 20, respectively.

Figure 21:
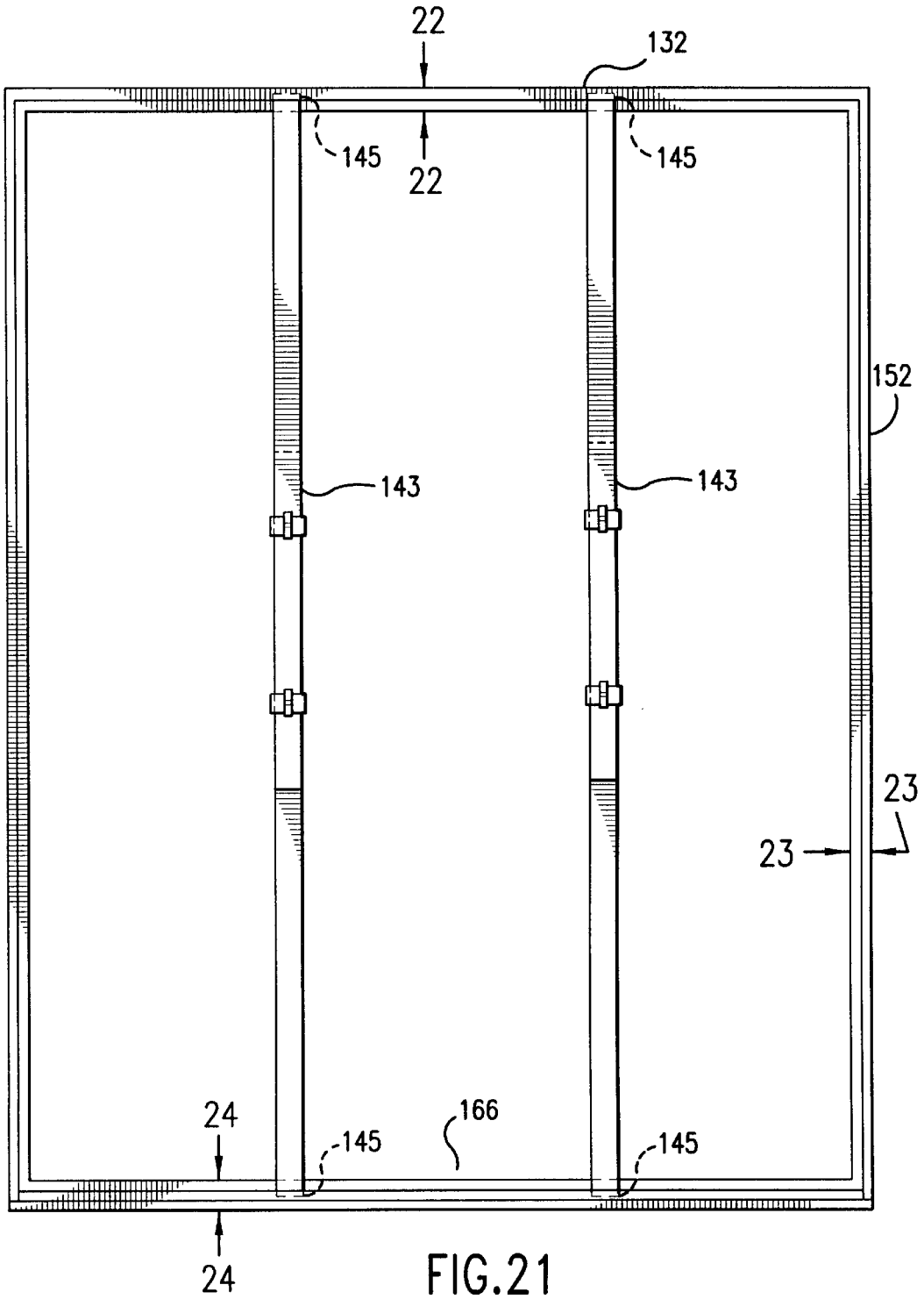
FIG. 21 is an elevation view of a fifth embodiment according to the present invention.
Figure 22:
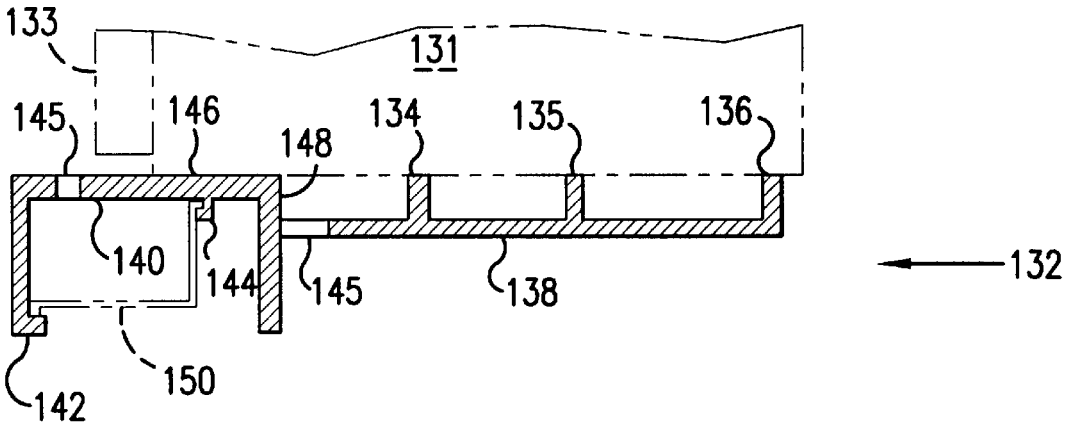
FIG. 22 is a cross-sectional view along line 22—22 in FIG. 21.

FIG. 21 shows a tee mullion 94*b* which performs the same function as described in the previous embodiments of the present invention. The tee mullion is comprised of primary member 96*b* main cross member 98*b*, and secondary cross member 10*b*.

Figure 23:
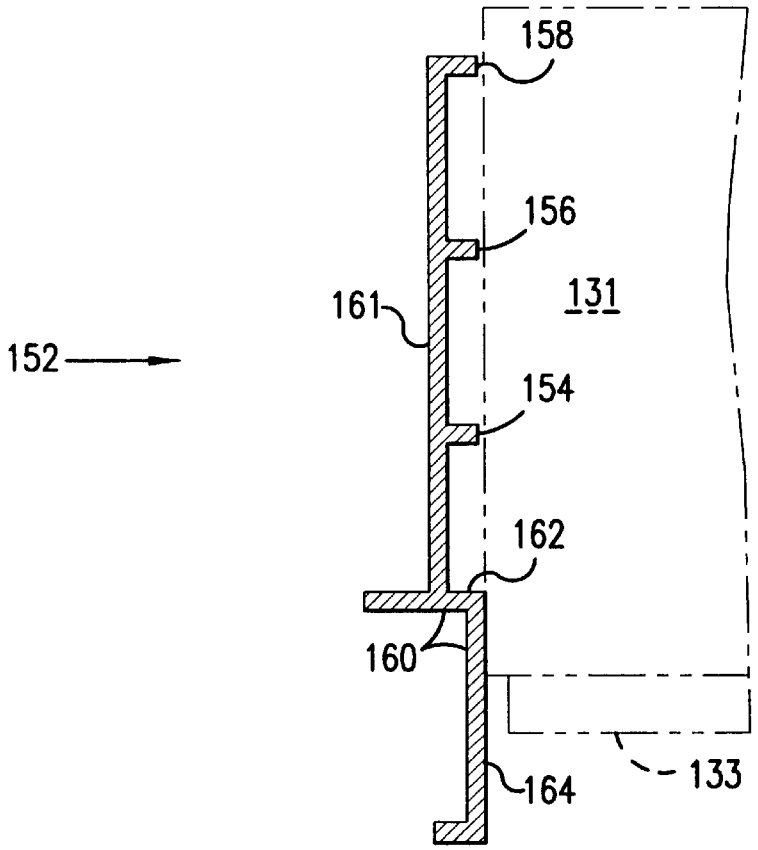
FIG. 23 is a cross-sectional view along lines 23—23 in FIG. 21.

FIGS. 22–25 are a fifth embodiment of the frame system according to the present invention. FIG. 23 is a cross-sectional view of a profiled head 132 which can be installed in a building aperture wherein a sliding glass door is to be installed. Profiled head 132 preferably traverses an upper portion of the building aperture such that support nubs 134, 135 and 136 engage a portion of the aperture surface traversing the distance between the interior and exterior sides of the building wall. Mounting surface 138 is provided for receiving a sliding glass door unit. As with the previously described embodiments in FIGS. 1–22, a head guide channel is provided for receiving a storm shutter.

Head locking tabs 142 and 144 are formed in profile head 132 for receiving a spring clip 150. Spring clip 150 can be inserted in head lock tabs 142 and 144 to act as a spacer in the event that a storm shutter to be installed is of insufficient thickness to fill the entire channel 140.

Figure 24:
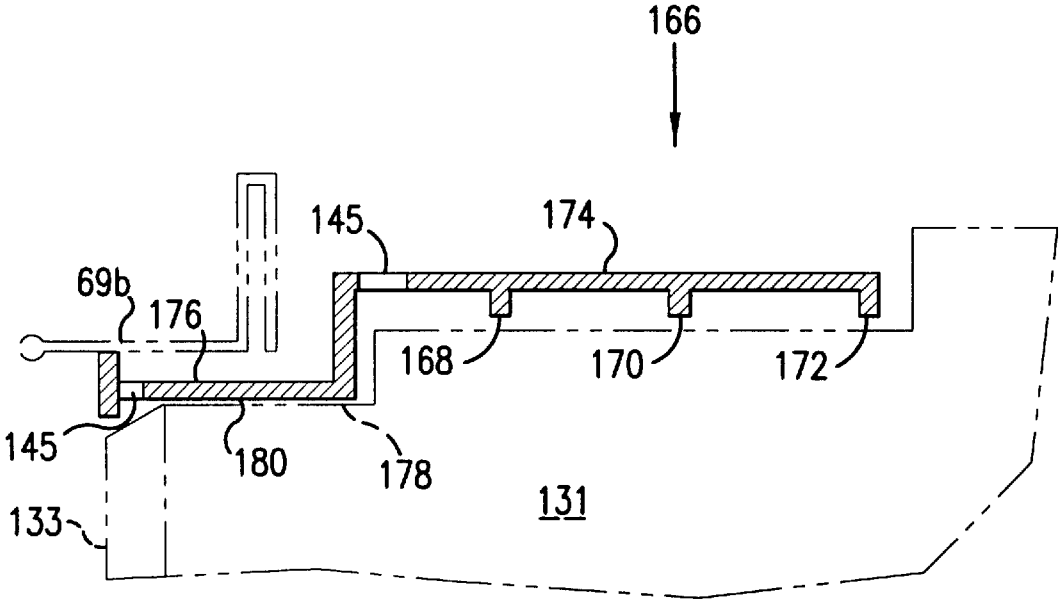
FIG. 24 is a cross-sectional view along lines 24—24 in FIG. 21.

FIG. 24, is a cross-sectional view of a profiled jamb 152 according to the present embodiment of the invention. Similar to the profiled head 132, profiled jamb 152 includes support legs 154, 156 and 158 for engaging a vertical surface of a doorway aperture traversing the distance between the interior and exterior surfaces of a building wall. L-shaped mounting brace 160 is provided for receiving a storm shutter as described in the previous embodiments. Finally, an exterior surface plate 162 and an exterior lip surface 164 are also provided.

Figure 25:
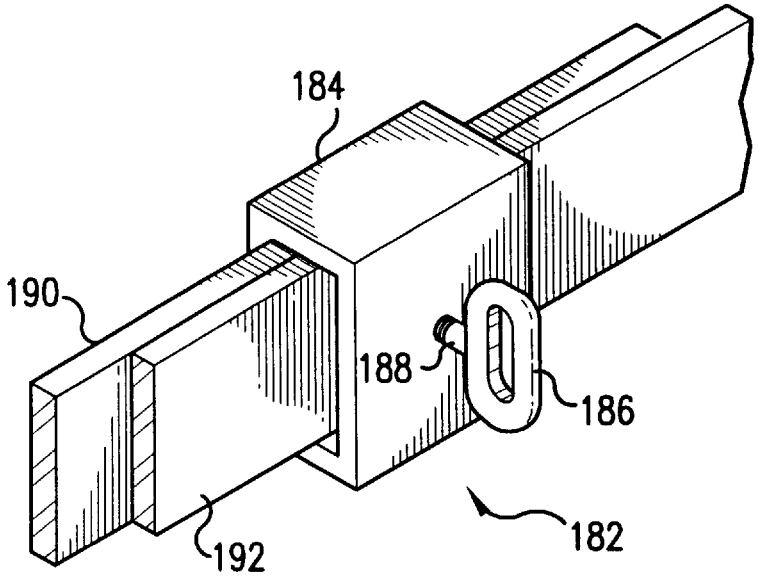
FIG. 25 is a cross-sectional view of a lock bar clamp of the type shown in FIGS. 1, 6, 11 and 16.
Figure 26:
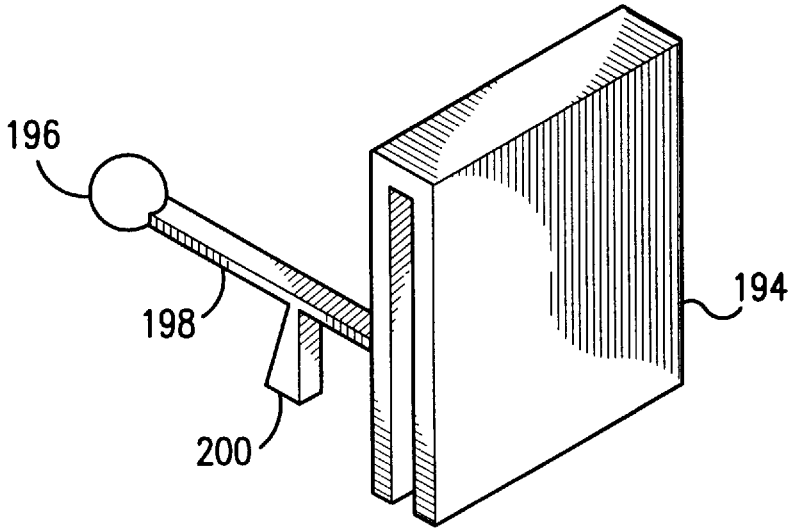
FIG. 26 is a perspective view of a spring tension aluminum clip of the type shown in FIGS. 9, 14 and 24.

FIG. 25 shows a cross-sectional view of a profiled sill 166 for use in the present frame system for a sliding glass doorway aperture. The sill 166 has a profiled configuration similar to jamb 152. Sill 166 includes a mounting surface 174, support nubs 168, 170 and 172, a mounting channel 176 and an exterior surface plate 178. Finally, an exterior lip surface 180 is also provided.

As with the previously described embodiments, the profiled head 132, profiled jamb 152 and profiled sill 166 are preferably mitred at each end and joined together to form a substantially rectangular sliding glass door frame system. The frame system is preferably installed in a building aperture for a sliding glass door such that exterior surface plate 148, 162 and 178 engage an unfinished exterior surface of a building wall adjacent to and surrounding the doorway aperture.

As with the previous embodiments, screws, bolts or any other suitable fastener may be used to attach the frame system within the building aperture. The frame system is preferably mounted to the portion of a building wall traversing the distance between the exterior and interior surfaces of the building wall defining the aperture.

The frame system is preferably positioned such that the interior-most support nubs 136, 158 and 172 associated with the profiled head, jamb and sill, respectively is substantially aligned with the plane defined by the interior surface of an unfinished building wall. When mounted in this position, exterior lip surface 146, 164 and 180 associated with the head, jamb and sill, respectively will protrude slightly beyond the exterior surface of the wall in which the doorway aperture is formed. In a preferred embodiment, an exterior finish can be applied to the exterior surface of the building walls such that less than the entire length of each of the above-referenced lip surfaces 146, 164 and 180 will protrude beyond the plane of the finished exterior surface. Specifically, the finished exterior surface should be slightly recessed behind the exterior-most edge of the frame system.

The sliding glass door frame system as shown in FIGS. 23–25 possesses advantages similar to those described with regard to the previously described window frame systems. Specifically, the frame system provides a superior strength mechanism for mounting storm shutters of a type not previously known. By integrally forming the storm shutter mounting system within the doorway frame system, it is possible to take advantage of the internal bracing provided by the sliding glass door unit itself. This, in turn, helps prevent the mounting system from being torn out of its mounting position by excessively high winds or impacts. Furthermore, a broader mounting surface is provided than would normally be possible for shutter mounting brackets alone. This feature results in greater stability as compared to previous shutter mounting systems.

Figure 27:
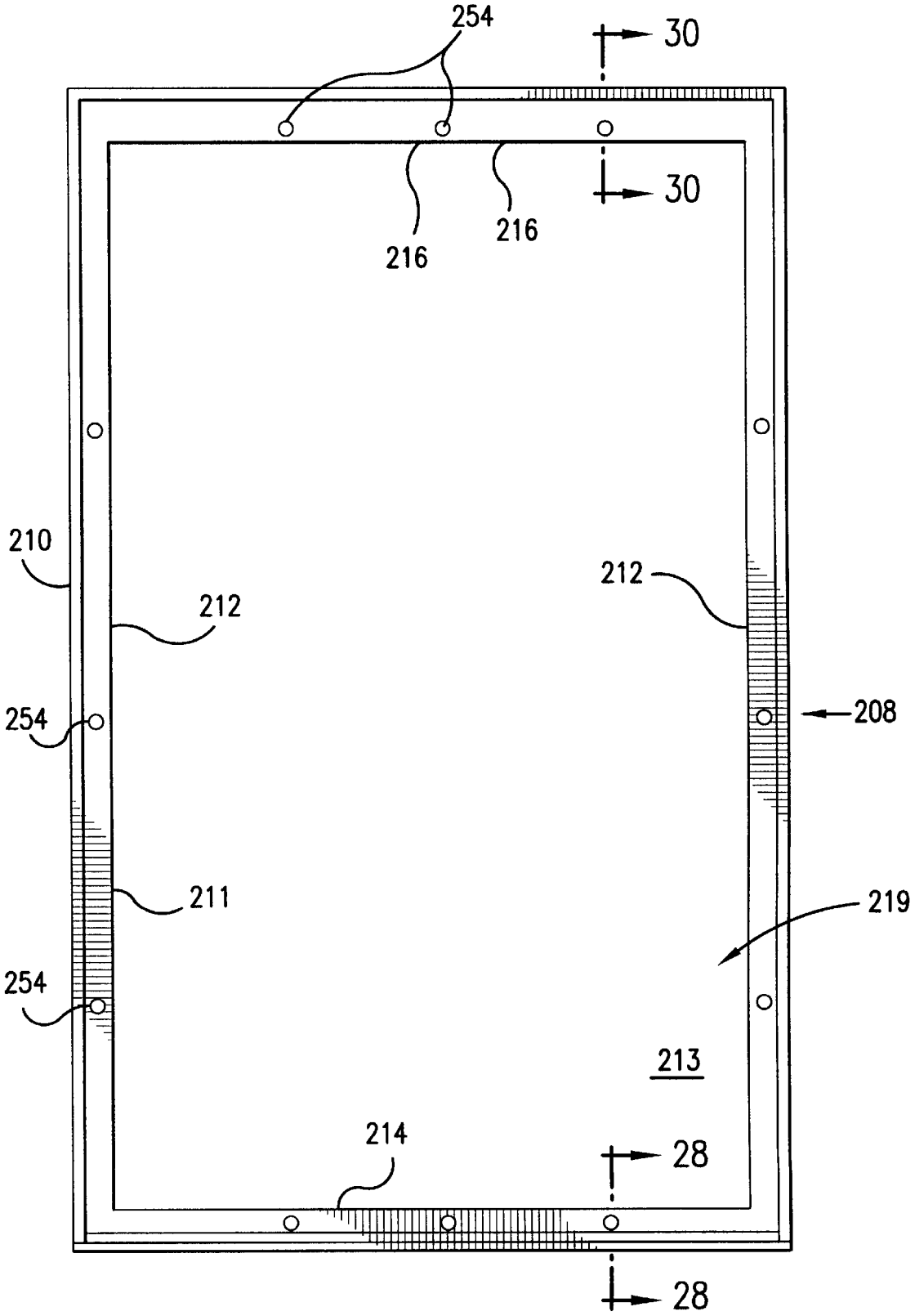
FIG. 27 is an elevation view of a sixth embodiment according to the present invention.

A sixth embodiment of the invention is shown in FIGS. 27–32. In FIG. 27, the system 208 is comprised of an outer frame 210, a mounting brace 211, a shield member 213 and a plurality of bolts 254. The outer frame 210 can be formed from two vertical jambs 212, a sill 214, and a header 216. The jambs, header, and sill 212, 214 and 216 are preferably mitred at the corners where they meet to form part of a rectangular frame. It is also preferable that many parts of the jambs, header and sill 212, 214, 216 be of an identical design so that manufacturing costs for the entire system are minimized.

The particular configuration of the jambs, header and sill 212, 214, and 216 shown in FIGS. 27–31 are designed for use with an 8" thick wall constructed of either concrete block or wood. Significantly, however, the invention is not so limited, and other configurations are possible.

As most of the components of the jambs, header and sill 212, 214, 216 are of an identical design in this sixth embodiment, identical components will be described in detail by referring to the sill 214 only. Where components differ between the sill, header, and/or jambs, the differences will be noted and detailed accordingly. Initially, it should be understood that the orientation of the jambs, header, and sill 212, 214, 216 will be different.

Figure 28:
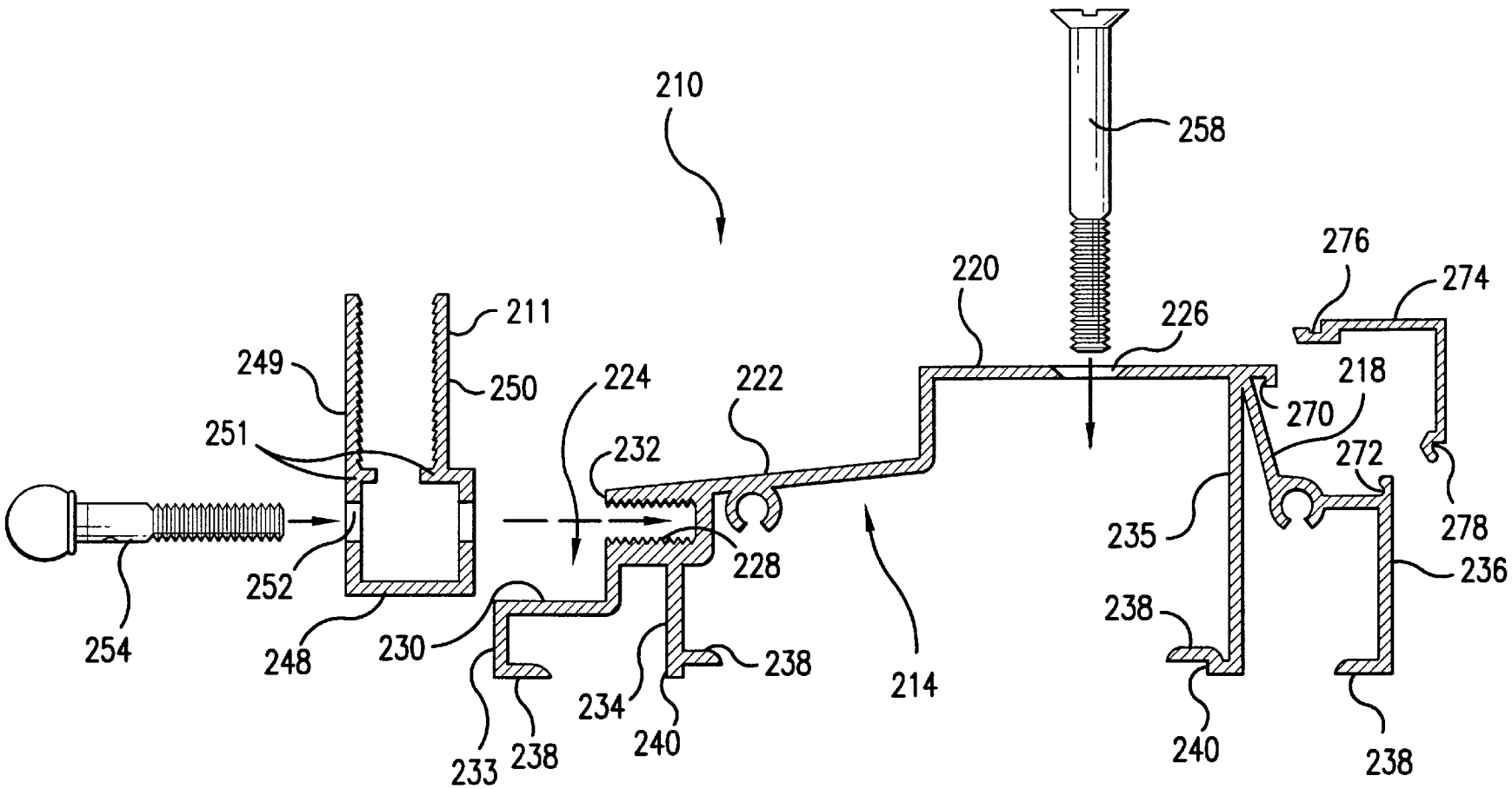
FIG. 28 is an exploded cross-sectional view of the frame system in FIG. 28 along lines 28—28.

Referring to FIG. 28, an exploded view of the framing system 208 according to the sixth embodiment can be observed. The sill 214 and associated components will have the orientation shown in FIG. 28. The framing system 210 includes a plurality of different parts including the sill 214, the mounting brace 211, and various other components which will be described below.

The sill 214 comprises several distinct portions, each performing a specific function. In particular, the sill preferably includes an interior spacer 218, a window mounting surface 220 raised above and connected to the interior spacer 218, an intermediate spacer 222 connected to the window mounting surface 220, and a shutter mounting structure 224 connected to the end of the intermediate spacer 222 opposite the end to which the window mounting surface is connected. Importantly, the sill 214 should at least provide an integrally formed window mounting surface 220 and an integrally formed shutter mounting structure 224 or channel. In a preferred embodiment, the window mounting surface 220 is slightly less than the thickness of a window unit (not shown in FIG. 28) to be mounted in the frame system. This allows the window unit to hang over the mounting surface 220 to provide a barrier to water and air passing through the seam therebetween. A mounting bolt aperture 226 can be provided in the window mounting surface 220 to facilitate securing the sill 214 to a window casing.

The intermediate spacer 222 provides clearance between components comprising a window unit and a shutter plane defined by the shutter mounting structure 224. The spacer 222 is preferably comprised of a downwardly-angled drip plate extending outwardly from the window mounting surface 220 so that the sill 214 does not define an upwardly facing channel between the mounting surface 220 and the mounting structure 224 that could retain water or debris.

The shutter mounting structure 224, according to the present invention, is preferably formed from a step-shaped portion of the sill profile defined by a first surface 230 which is substantially parallel to the window mounting surface 220 and a second surface 232 which is perpendicular to the first surface 230 and connects the first surface 230 to the intermediate spacer 222. A threaded continuous screw channel 228 is provided in, and is perpendicular to the second surface 232. The screw channel 228 extends the length of the sill 214.

While separate screw bores spaced along the length of the sill could be used instead of a screw channel and are clearly contemplated by this invention, preferably, for a number of reasons, a sill channel is used. One reason is that the sill channel makes the entire system more versatile. The number of screws needed to hold a shutter in place will be related to the severity of weather expected. Thus, where more severe weather is contemplated, more screws should be employed. With a screw channel, instead of designing different sills with different numbers of screw bores, a single sill, having a channel that can accommodate any number of screws is provided. Also, if one part of the channel becomes stripped, another part can be used to anchor a screw. Furthermore, when the shutter is not installed, the screw channel provides a sharp and aesthetically pleasing line as opposed to periodic bores which tend to make the frame look unfinished.

Four support legs 233, 234, 235 and 236 are provided on the rear surface of the sill 214. Each support leg 233, 234, 235 and 236 includes a foot member 238 that extends perpendicular to an associated leg and in the direction toward the window mounting surface 220. The foot members 238 on the two most centrally located support legs 234 and 235 extend from a point above the distal ends of the legs, leaving a heal extension 240. The foot members 238 on the two distal legs 233, 236 extend from the ends of the legs.

The sill jamb 214 is designed to be mounted such that the foot members 238 on legs 233 and 236 and the heal extensions 240 engage the sidewall of a building aperture along the lower edges of the aperture. For the purpose of this description, a sidewall is understood to mean the portion of the building wall traversing the distance between the interior and the exterior surfaces of the wall.

Referring again to FIG. 29, the shutter 219 consists of the shield member 213, the mounting brace 211, and the plurality of frame bolts 254. The shield member 219 is manufactured from a metal, fiberglass, wood or composite material comprised of wood or plastic or a clear plexiglass type material. The shield member 214 substantially fills the area defined by the shutter mounting structure 224. Referring also to FIGS. 27 and 28, mounting brace 211 is manufactured from steel, fiberglass or some other hard and strong material and circumscribes the entire shield member 213. The mounting brace 211 frames the shield member 213 and, like the frame 210, includes four parts that are mitred at their ends where they meet to form a rectangular frame.

Figure 29:
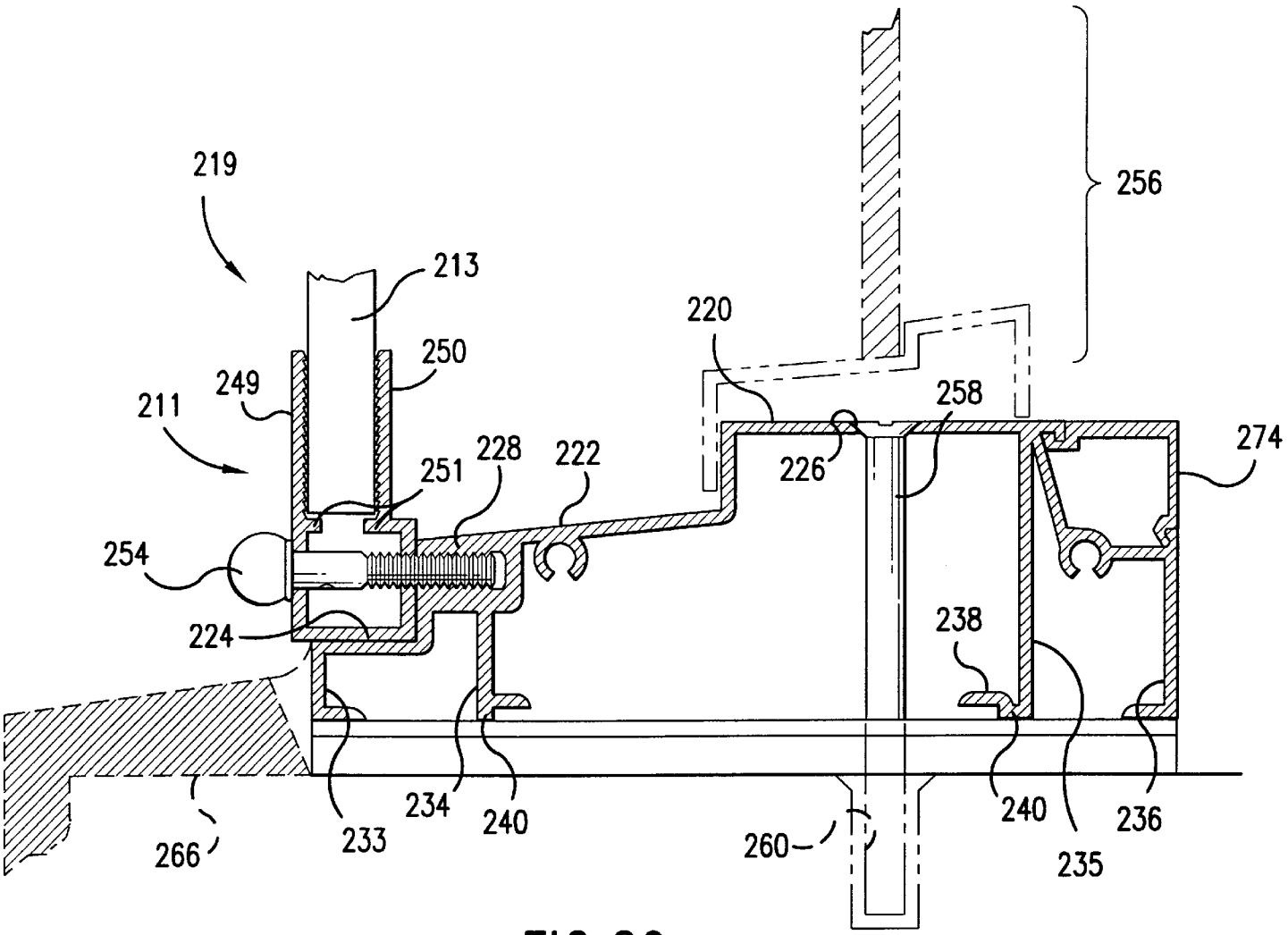
FIG. 29 is a cross-sectional view along lines 28—28 in FIG. 27.

In the embodiment shown in FIGS. 28 and 29 the mounting brace 211 has a substantially U-shaped cross-section including an edge member 248 which connects adjacent ends of two opposing lateral members 249, 250. An elongated nub 251 is positioned on the internal surface of each lateral member 249, 250, dividing each lateral member substantially in half, the two nubs 251 being dimetrically opposed. The nubs 51 divide the area between the lateral members 249, 250 into a shield receiving area between the nubs 51 and the distal end of the member 249, 250 and a void area between the nubs 251 and the edge member 248. When assembled, the shield member 213 is received between the lateral members 249, 250 of the mounting brace 211 in a secure fashion, each edge of the shield member resting on adjacent elongated nubs 251.

A plurality of holes 252 are provided in the mounting brace between the nubs 251 and the edge member 248. Each hole 252 extends through, and is perpendicular to, the lateral members 249 and 250. Each hole 252 should be positioned such that, when the mounting brace 211 is received within the shutter mounting structure 224, the hole 252 is axially aligned with an adjacent portion of the screw channel 228.

When dangerous weather is reported, the shutter 219 can easily be taken from the storage area, placed within the shutter mounting structure 224, and fastened in place. When assembled, bolts 254 extend through holes 252 and into aligned portion of the screw channel 228 along the length of the mounting brace 211. Importantly, referring to FIG. 29, the shutter mounting structure 224 receives the mounting brace 211 and aligns the brace 211 so that the shield member 213 is perpendicular to the mounting surface 220. Referring also to FIG. 27, bolts 254 are provided at periodic intervals along the length of each jamb, the header and the sill 212, 214, 216. In FIG. 27 three bolts are provided along each jamb, header and sill 212, 214, 216. However, depending upon the nature of the weather, the thickness and mass of the shutter, and the length of each bolt 254, the system can incorporate any suitable number of bolts 254.

When assembled, the foot extensions on legs 233 and 236 and the heal extensions 240 all contact an aperture side wall thus providing ample support for a mounted window unit 256. A jamb bolt 258 extends through the hole 226 and down into an anchoring bore 260 within the side wall of the aperture. A plurality of bolts 258 should be used to hold the jamb within the wall aperture. Importantly, the entire framing system should be designed so that when the window unit 256 is installed, the majority of the unit weight is approximately above the bolts 258. In this manner much of the unit weight is supported by the bolts 258.

Once mounted, the frame system 208 provides a secure and ample window unit mounting surface 220. More importantly, however, the frame system 28 also provides an integrated shutter mounting structure 224 having superior strength characteristics. When mounted, the mounting brace 211 is flush, or is nearly flush, with the external surface of leg 233. Thus, it is nearly impossible for wind and/or debris to rip the shutter 219 from its mounted position.

In addition, the superior strength characteristics of the present frame system result from several other factors. One important factor is that additional structural support is provided to the elongated alcove 224 by the window or glass door unit 256 itself. A window unit 256 as referred to herein includes an independent frame for supporting glass panels. Thus, a window unit mounted within the outer frame 210, according to the present invention, internally braces the frame system 208, including the integrally formed elongated alcove 224. In addition, the wider mounting surface defined by the jambs, header, and sill 212, 214, 216 provides a larger area for locating mounting bolts 258 than would typically be possible for a separately mounted shutter receiving frame. This permits stronger mounting and a more stable base.

In addition, utilizing a frame system according to the present invention simplifies system manufacturing, building construction, and results in an improved appearance. Manufacturing is simplified because only a single jamb configuration is necessary. The jambs, header and sill used in this embodiment of the invention are identical. The mounting brace 211 is also of a constant cross section which result is simplified manufacturing. Construction is simplified because a builder can avoid the additional step of installing and aligning independent elongated alcoves. Appearance, however, is also improved since the alcoves can be more smoothly integrated with the outer siding of a building which is being constructed.

Figure 30:
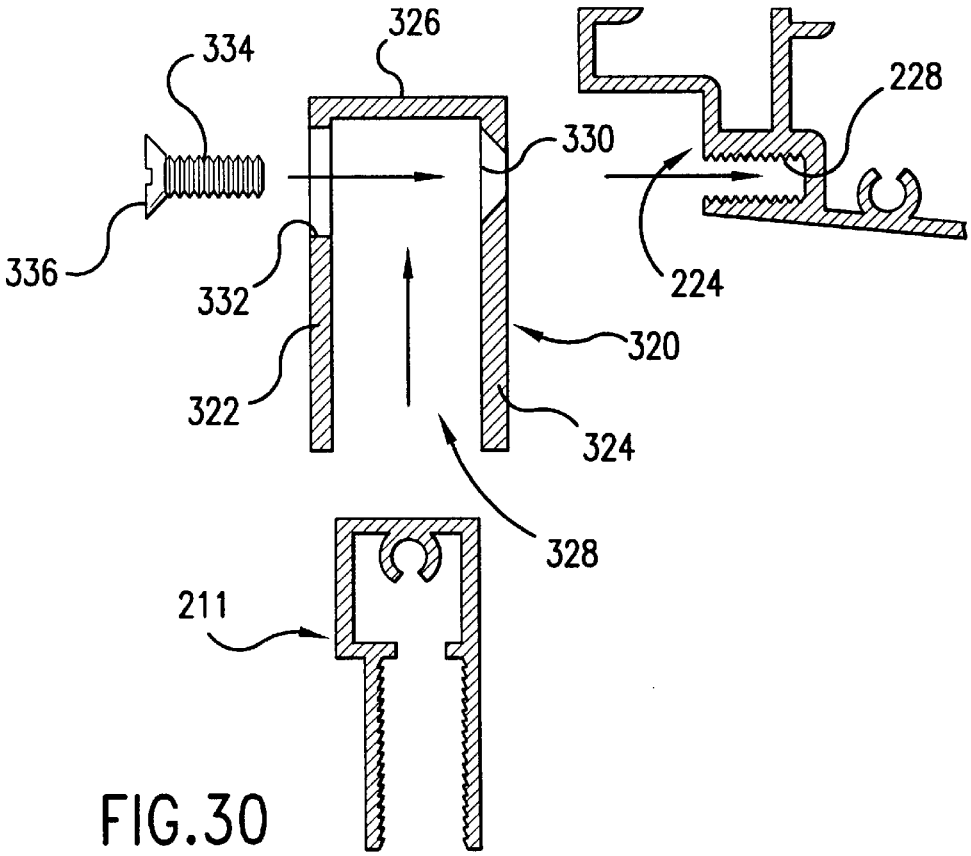
FIG. 30 is an exploded cross-sectional view including a header bracket along the line 30—30 in FIG. 27.

Referring to FIG. 30, a header bracket 320 can be provided to facilitate easy installation of the shutters. The header bracket 320 has a substantially "U"-shaped cross section, having two downward extensions 322, 324 and a connecting extension 326 connecting the two downward extensions 322, 324 so that a downwardly facing channel 328 is formed. Channel 328 should be slightly wider than the width of the widest section of the mounting brace 211 so that the brace 211 can be snugly received within the channel 328. As with the mounting brace 211, the header bracket 320 can be provided with a plurality of screw bores 330, 332 that align with the screw channel 228 in the shutter mounting structure 224. The bores 332 in the external extension 322 should be relatively wider so that the head of a mounting screw 334 can pass through.

Figure 31:
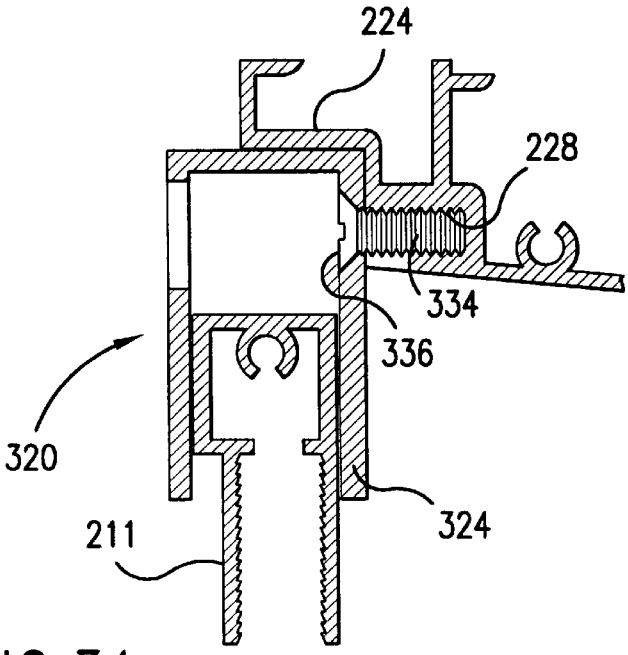
FIG. 31 is a cross-sectional view along line 30—30 in FIG. 27.

Referring to FIG. 31, when the mounting bracket 320 is installed, the bracket 320 is received within the shutter mounting structure 224. The bracket 320 is held in place by mounting screws 334 extending through the internal extension 324 and securely received within the screw channel 228. The face of each screw 334, when installed, should be flush with the internal surface of the internal extension 324.

Once the bracket 320 is installed, the mounting brace 211 can easily be slipped in and out of the channel 328. When received within the channel 328, the bracket 320 supports the brace 211 in the mounted position. With the upper edge of the brace 211 secured by the bracket 320, the other three edges can be fastened using bolts as described above.

Referring to FIG. 29, in a preferred embodiment, the frame system according to the present invention can be installed in a building aperture such that the interior surface of leg 236 is flush with an interior wall. When so constructed, a trim member 274 may be provided to give the interior extension a finished look. Referring to FIGS. 28 and 29, snap members 270, 272 can be provided on the sill 214 for receiving a trim member 274. The trim member 274 can be of any finishing shape (rectangular is shown) but should have snap members 276, 278 that complement the sill snap members 270, 272. The trim member 274 should be constructed of a resilient plastic so that it can be temporarily deformed for installation. An installed trim member 274 can be seen in FIG. 29.

Support leg 233 is preferably aligned with the exterior surface of an unsided wall of the building under construction. When mounted in this manner, siding 266 can be installed so as to provide an open pocket adjacent leg 233. A sealing material such as cement or plaster may be filled into the pocket to effect a strong seal.

Figure 32:
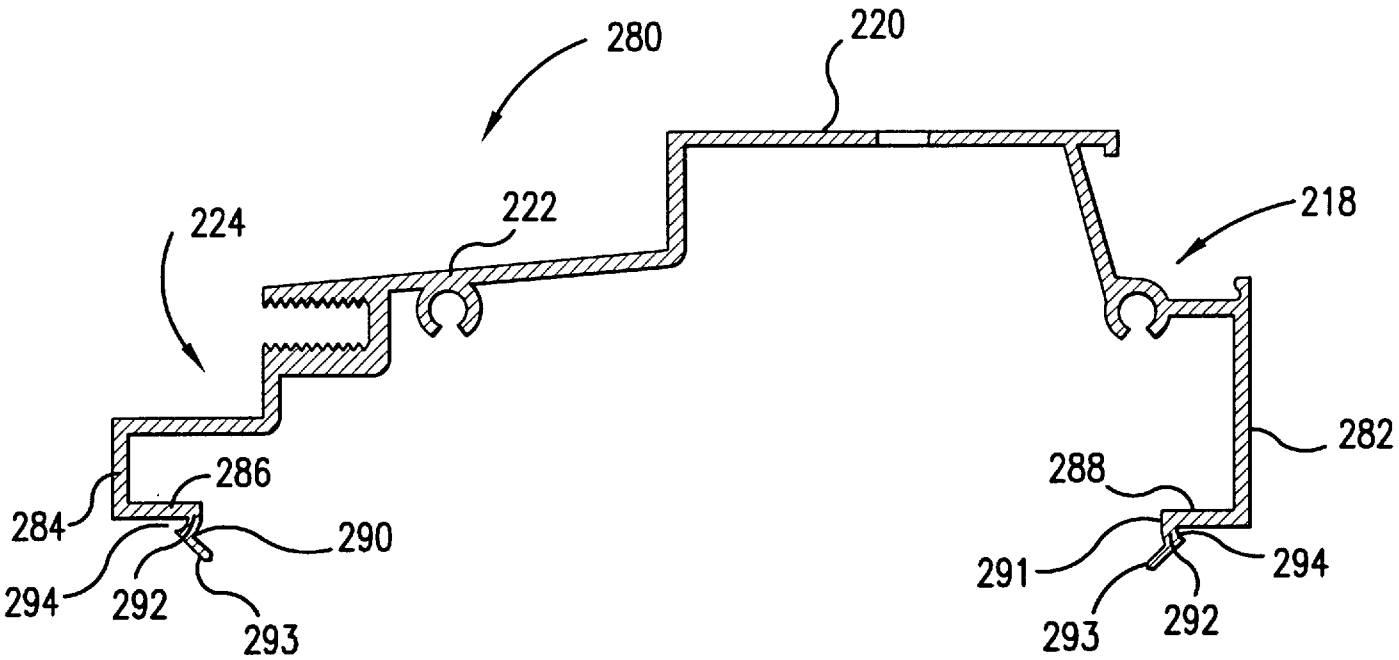
FIG. 32 is a cross sectional view of a joining jamb used for mounting a plurality of shutters shown in FIG. 27, side by side.

Referring to FIG. 32, a joining jamb 280 for use with the sixth embodiment in aligning and supporting adjacent windows and shutters can be observed. The window mounting surface 220, intermediate spacer 222, shutter mounting structure 224, and interior spacer 218 are all substantially as described above with reference to the sixth embodiment. The support legs, however, are preferably different. Instead of having four support legs, the joining jamb 280 has only two, an internal leg 282 and an external leg 284. Each of the legs 282, 284 has a foot extension 286, 288, the two foot extensions 286, 288 extending toward each other. Each foot extension 286, 288 has a downwardly hanging toe extension 290, 291 including a neck portion 292 and a head portion 293. Adjacent head and neck portions together form a recess 294, one recess under each foot extension 286, 288.

Figure 33:
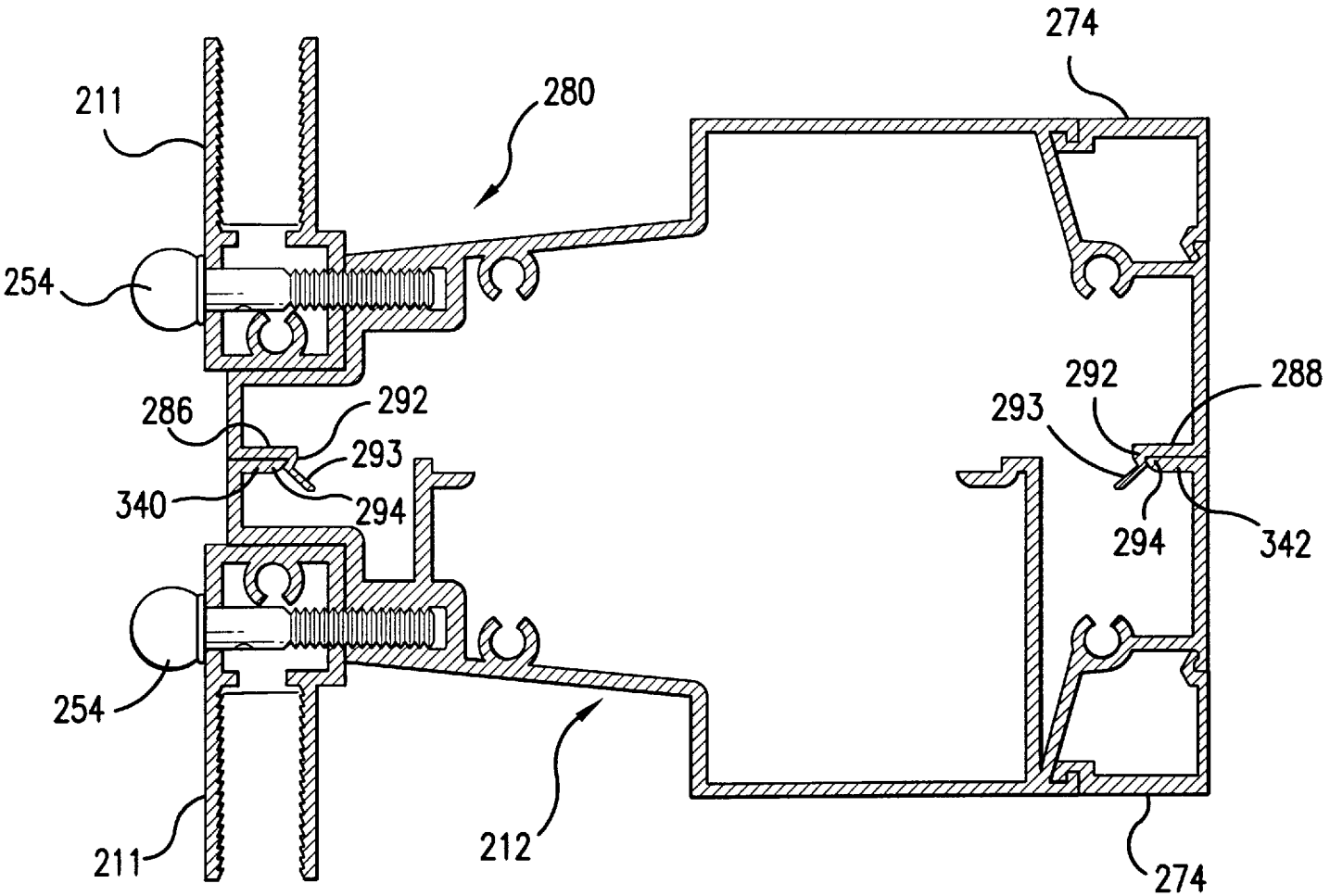
FIG. 33 is a cross-sectional view of a joining jamb and an adjacent jamb for mounting a plurality of frames shown in FIG. 27 side by side.

Referring also to FIG. 33, the foot extensions 286, 288 should be positioned so that when an adjacent jamb 212 is attached to the joining jamb 280, adjacent foot extensions 340, 342 are received within the recesses 294. The neck portions 292 should be resilient so that after the two jambs 212, 280 are forced together, the head and neck portions 293, 292 assume their original positions and lock the two jambs 212, 280 together. Once assembled as shown in FIG. 33, adjacent mounting braces 211 can be attached using bolts 254 and trim members 274 can be added to provide a finished look as described above.

Figure 34:
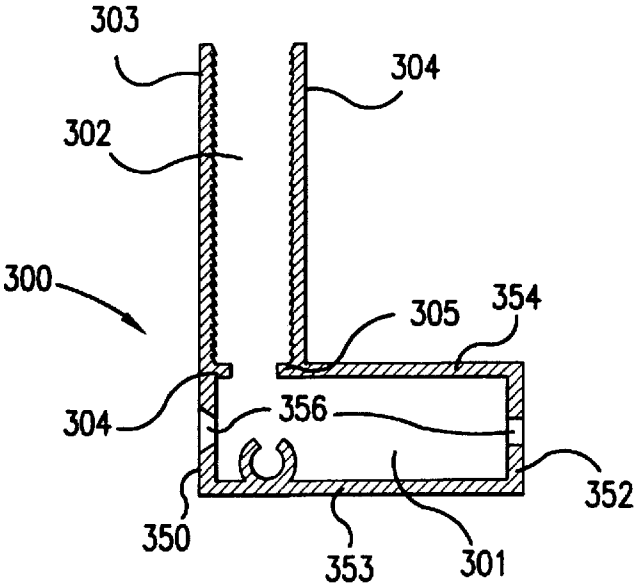
FIG. 34 is a cross sectional view of a preferred embodiment of a mounting brace.

Referring now to FIG. 34, a second embodiment of the mounting brace 300 is shown. This mounting brace 300 has a substantially L-shaped cross section having a base section 301 and beam section 302 which is perpendicular to the base section 301. The beam section 302 has two lateral extensions 303, 304 which extend upright and oppose each other. Two nubs 304, 305 are positioned at the bottom of the lateral members 303, 304 on the internal surface of the beam section 302. The base section 301 is substantially hollow having two lateral members 350, 352, an end member 353 connecting two ends of the lateral members 350, 352, and a spacer member 354 connecting the bottom end of lateral member 304 to the top end of lateral member 352. Each lateral member 350, 352 has a plurality of screw bores 356 along its length that, as with the brace member described earlier, align with the screw channel when the brace 300 is positioned for use.

When assembled, the edge of a shutter member (not shown in FIG. 34) is received tightly between two lateral members 303, 304, the mounting brace offering support to the lateral edges of the shutter member. When mounted, the base section 301 is either fully or partly received within a shutter mounting structure as described above. Importantly, the base extension 301 allows for additional clearance between the shutter and a mounted window.

This embodiment of the mounting brace is important where the shutter member is constructed out of relatively flexible material. For example, plexiglass tends to bend much more easily than other more rigid shield materials (i.e. wood or metal sheeting). If a shutter member is constructed out of plexiglass, when debris impacts the shutter member, if the intermediate spacer 222 (see FIG. 29) does not provide sufficient clearance, the shutter member 213 could easily impact and destroy a window unit 256. The "L"-shaped mounting brace 300 shown in FIG. 34 adds an additional spacer member 354 and additional clearance to protect a mounted window unit.

Figure 35:
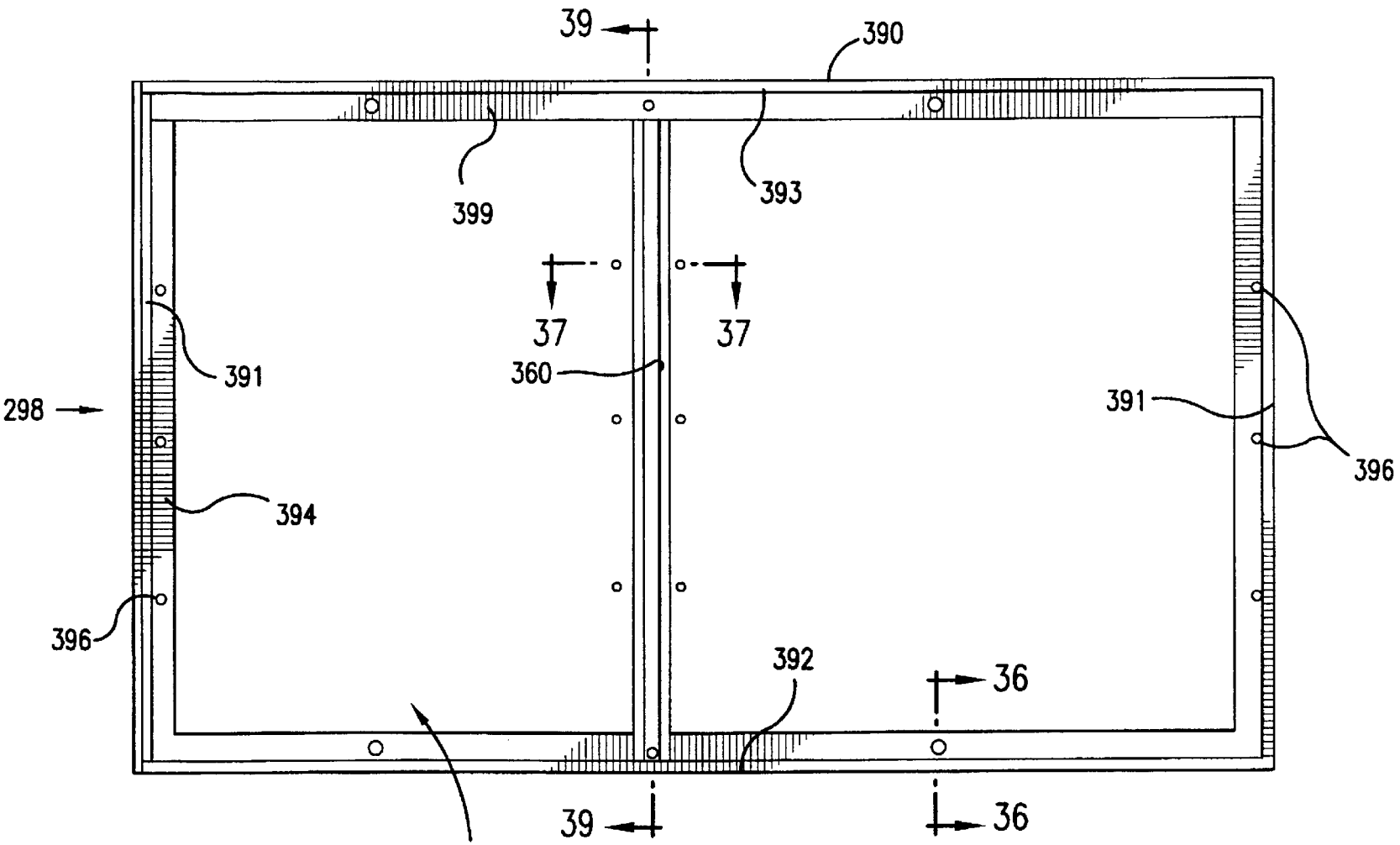
FIG. 35 is an elevational view of a seventh embodiment according to the present invention.

Referring now to FIGS. 35–39, a seventh embodiment of the present invention, which is similar to sixth embodiment, can be observed. In FIG. 35, the system 298 according to the seventh embodiment is comprised of an outer frame 390 which is formed from profiled jambs 391, a profiled sill 392, a profiled header 393, a header bracket 399, a mounting brace 394, at least one shutter member 395, and if needed, a support mullion 360. As with the sixth embodiment, many of the components of the jambs, sill, and header, 391, 392, 393 are substantially identical and therefore, unless a difference exists only a single jamb 391 will be described. Profiled jambs, sill, and header 391, 393 are preferably mitred at the corners where they meet to form part of a rectangular frame. The mounting brace 394 and member 395 can be mounted to the outer frame 390 by a plurality of bolts 396 as shown. The header 399 is mounted to the header bracket 393 as described in relation to FIG. 31 with reference to the sixth embodiment.

Figure 36:
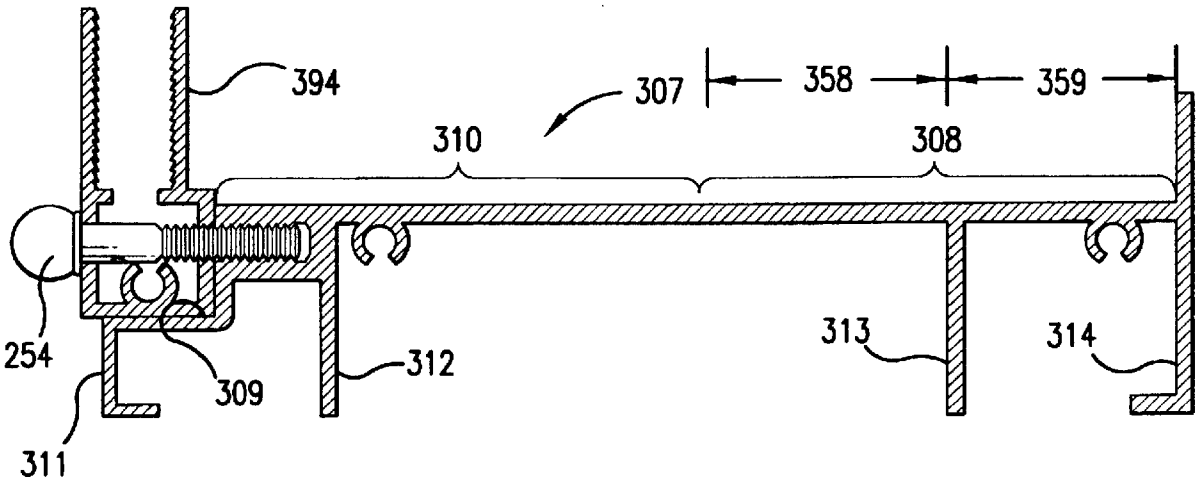
FIG. 36 is a cross sectional view of the seventh embodiment along lines 36—36 in FIG. 35.

Referring also to FIG. 36, the system of the seventh embodiment is specially designed to be used for sliding glass doors, store fronts or the like where an area to be protected is relatively large. In FIG. 36, the jamb 307 primarily consists of a window mounting surface 308, a storm shutter mounting structure 309, an intermediate spacer 310 between the window mounting surface and the storm shutter mounting structure 309, and a plurality of legs 311, 312, 313, 314 extending off the back of the jam 307 which contact the surface of a door or window alcove. The brace 211 is received within and secured by bolts 254 in the same manner as described above with reference to the sixth embodiment.

Most importantly, the embodiment shown in FIG. 36 has a wide intermediate spacer 310. The wide intermediate spacer 310 allows for the jamb 307 to be used with sliding glass doors that move in two adjacent and parallel planes 358, 359. Because two doors, as opposing to one window mounting surface, must be accommodated, a wide intermediate spacer must be provided. In addition, the wide spacer 310 provides clearance for door hardware such as a handle (not shown) that might be positioned on the outside of an externally positioned door.

Furthermore, the wide spacer 310 provides more clearance generally between the plane defined by the shutter mounting structure 309 and the window mounting surface 308. Because this seventh embodiment is to be used with relatively large windows, the shutter members employed will generally be larger. As the central portions of the large shutter members will be distant from a surrounding mounting brace on other additional supporting structure, these positions will tend to bend more readily when struck with debris. Hence, additional clearance is needed between the shutter member and a window or door unit and the wide intermediate spacer 310 provides the necessary clearance.

Figure 37:
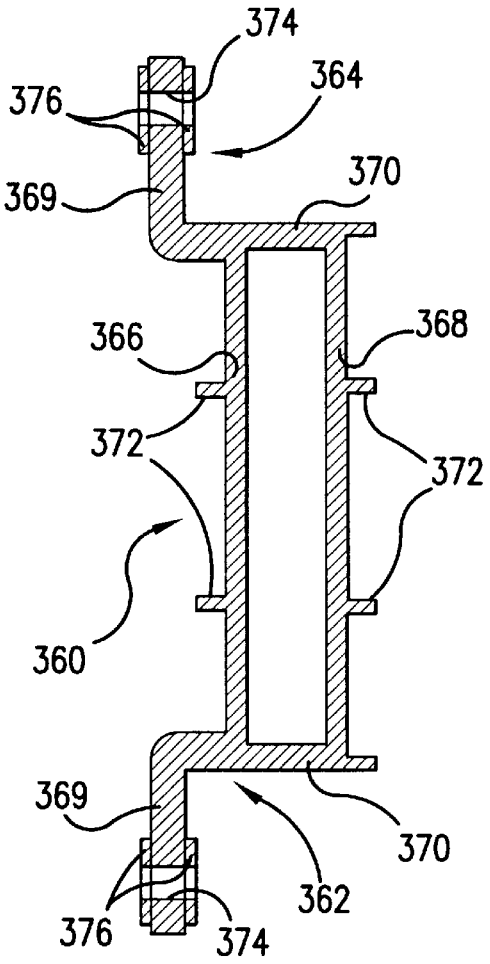
FIG. 37 is a cross-sectional view along line 37—37 of FIG. 35.

FIGS. 35 and 37 show an "A" mullion 360 for use in aligning and supporting, side by side, a plurality of shutter members of the type used with the seventh embodiment. The A mullion 360 is comprised of two opposite facing "L"-shaped shutter mounting structures 362, 364, and two parallel support members 366, 368. The mounting structures 362, 364 each have one distal member 369, the distal members 369 together defining a single plane. Each distal member being connected to a remote member 370 which is perpendicular to the distal member 369. Each distal member 369 has a threaded receiving hole 374 which is perpendicular to the member 369. A hole extension 376 is provided on either side of each receiving hole 374 to provide additional screw receiving surface. The support members 366, 368 connect the remote members 370 so that the remote members 370 and support members 366, 368 together form a rectangle. On the external surface, each support member 366, 368 includes a plurality of support ribs 372, each rib extending the length of the support member 366, 368 and making the support member 366 or 368 more rigid.

Figure 38:
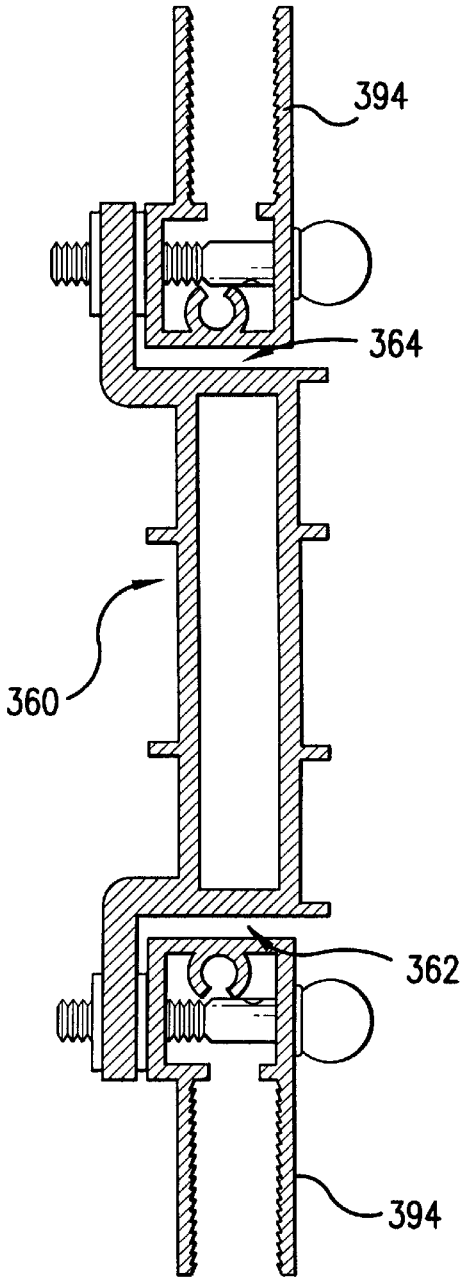
FIG. 38 is a cross-sectional view of the A mullion along line 37—37 of FIG. 37 in an installed position.

Referring also to FIG. 38, when it is desired to mount storm shutters according to the seventh embodiment and a plurality of shutters are to be mounted adjacent each other, the mullion 360 can be bolted between two mounting braces 394, the braces 394 being received within the mounting structures 362, 364. The mullion 360 not only allows two or more relatively smaller shutter members to cover a window or door, but also provides additional support to the shutter members.

Figure 39:
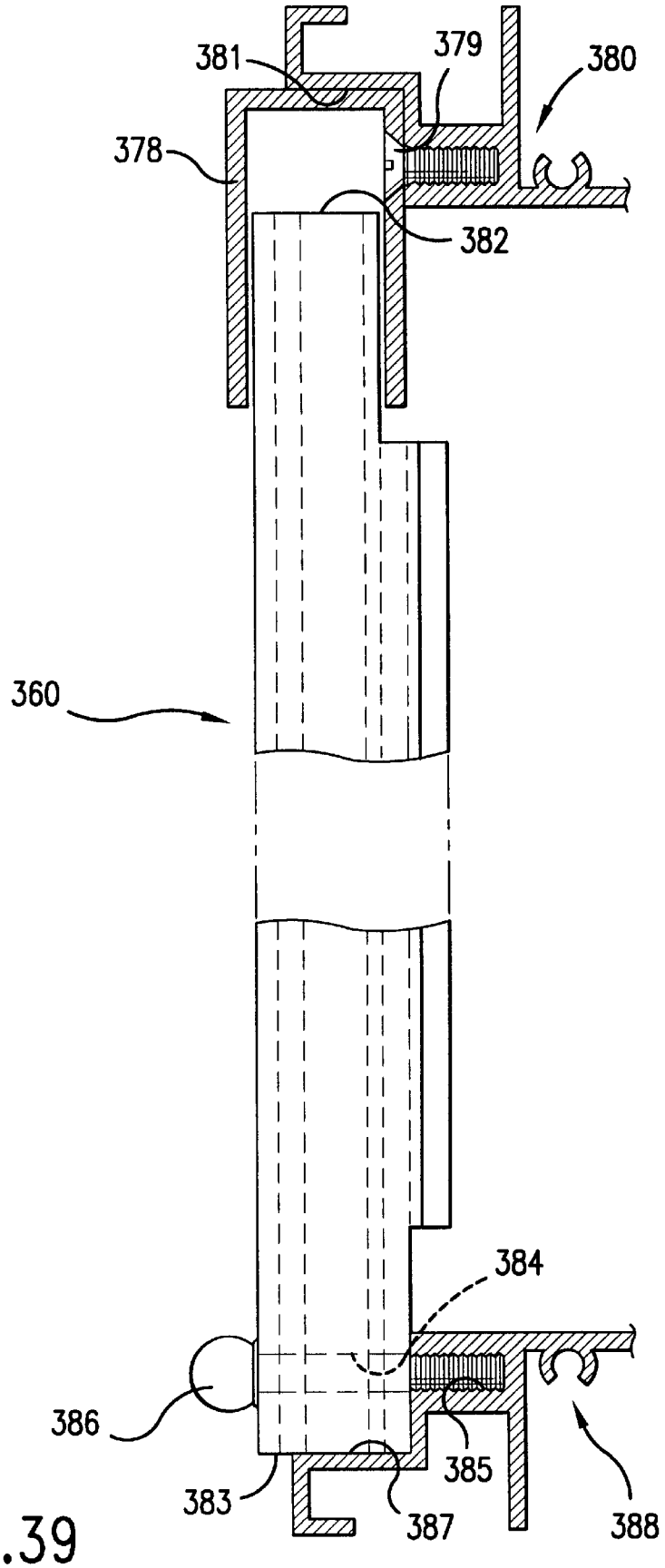
FIG. 39 is a cross-sectional view along lines 39—39 of FIG. 35.

To increase the support capability of the mullion 360, preferably, the upper and lower ends of the mullion 360 are securely attached to the shutter mounting structure traversing the distance between the header and sill jambs, as seen in FIG. 35. Referring also to FIG. 39, as in the sixth embodiment, a header bracket 378 may be used to secure the upper end 382 of the mullion 360 within the mounting structure 381. At the lower end 383 a bore 384 through the mullion 360 and aligned with an adjacent screw channel 385 that receives a mounting bolt 386 can be used to secure the lower end 383 of the mullion 360 in the mounting structure 387 of the sill 388.

It will be appreciated that numerous embodiments and modifications of the above-described frame systems may be devised by those skilled in the art, and it is intended that the appended claims cover all such modifications and embodiments as follows in the true spirit and scope of the present invention. For example, referring to FIG. 29, the window unit 256 includes a secondary jamb which sits on top of the window mounting surface 220. In addition to offering support to the window, the secondary jamb also hides the head of bolt 258 when installed. If desirable, the secondary jamb may be incorporated in the sill 214 and the sill 214 may be attached to the window aperture in some other fashion. In addition, the frame structure 210 may include one or more support bars extending from one edge of the aperture frame system to the other to provide support to the shield member 219. It is clearly possible to provide a mounting brace 218 that is fastened to a jamb along only one or two jamb portions (i.e. only along the first and second or header and sill jambs). Moreover, while bolts are employed in the above described embodiment, any known method of fastening the jambs to an aperture side wall could be employed.

To apprise the public of the scope of the invention, the following claims are made:

I claim:

1. A building aperture frame system for placement in a building aperture at least partially defined by first and second vertical side walls traversing the distance between an exterior and interior surface of a building wall, the system for receiving both a shutter panel and a window, the system comprising:

first and second vertically directed profiled jambs spaced apart and diametrically opposed to each other, each said jamb having;

a first elongated edge defining an interior face, a second elongated edge oppositely spaced from said first elongated edge and defining an exterior face, a width extension, said width extension being defined respectively as that portion of said jambs traversing the distance between said interior and exterior faces, said width extension having an inner side facing the interior of the area enclosed by said aperture frame and an oppositely facing outer side, a window mounting surface integrally formed on a portion of said width extensions;

a storm shutter mounting structure integrally formed on each of said width extensions, said storm shutter mounting structure being adapted for adjustable threaded engagement by means for securing said shutter panels and being positioned along a portion of said width extensions between said exterior face and said window mounting surface;

a header mounted to and traversing a distance between an upper end portion of each of said first and second profiled jambs;

a sill mounted to and traversing a distance between a bottom end portion of each of said first and second profiled jambs, said header and said sill being diametrically opposed each to the other;

a mounting brace having two U-shaped cross-sectionally contoured lateral mounting portions defining a header mounting portion and a sill mounting portion, said header mounting portion traversing the distance between an upper end portion of each of the lateral mounting portions and the sill mounting portion traversing the distance between a lower end portion of each of the lateral mounting portions, the mounting brace formable around the shutter panel and received between the shutter mounting structures of the jambs, header and sill, each of said lateral mounting portions including two opposing lateral members and an edge member connecting adjacent ends of the two lateral members, the edges of the shutter panel being received between the lateral members, said mounting brace being positioned within a plane defined by the shutter mounting structures, said mounting brace having a substantially L-shaped cross-section including a base member and a beam member which is substantially perpendicular to the base member, the beam member having two opposing lateral members, the edges of the shutter panel being received between the lateral members;

an elongated nub positioned on the interval surface of each lateral member of each of said lateral members of said mounting portion; and, said mounting brace includes at least one hole extending through the mounting brace substantially perpendicular to the lateral members, the storm shutter mounting structure including a screw receiving base that is axially aligned with the holes in the mounting brace when the shutter panel is in a mounted position and the system includes at least one screw extending through the hole and received in the screw base to secure the mounting brace in the mounted position.

2. The system as recited in claim 1 wherein each of said elongated nubs is positioned dividing each lateral member substantially in half, the nubs being diametrically opposed, each edge of the shutter panel restable on an adjacent pair of opposing nubs.

3. The system as recited in claim 2 wherein the at least one screw receiving bore is a continuous screw channel, the at least one hole is a plurality of holes, and the at least one screw is a plurality of screws.

4. The system as recited in claim 3 wherein the holes in the mounting brace pass between the nubs and an adjacent edge member.

5. The system as recited in claim 1 wherein the width extension on each of the jambs includes an intermediate spacer between the storm shutter mounting structure and the window mounting surface.

6. The system as recited in claim 1 wherein the first and second jambs are further comprised of a plurality of support legs extending away from the outer side of said width extension.

7. The system as recited in claim 1 wherein the storm shutter mounting structure includes:

a substantially flat first sunken surface which is approximately vertical; and a substantially flat second sunken surface that is perpendicular to the first sunken surface.

8. The system as recited in claim 1 wherein the system includes a header bracket, the bracket having a substantially "U"-shaped cross section formed by two parallel and opposing header lateral members and a header edge member connecting adjacent ends of the header lateral members, the header edge and lateral members forming a receiving channel, the header mounting portion being tightly receivable within the receiving channel, the header bracket receivable and securable within the shutter mounting structure of the header so that the receiving channel faces the shutter mounting structure on the sill.

9. A storm shutter system for a building aperture comprising:

first and second jambs spaced apart and positioned vertically and diametrically opposed to each other;

a header mounted to and traversing a distance between an upper end portion of each of said first and second jambs;

a sill mounted to and traversing a distance between a bottom end portion of each of said first and second jambs, the header and sill being diametrically opposed to each other;

each of said first and second jambs, header and sill having, a first elongated edge defining an interior face, a second elongated edge oppositely spaced from said first elongated edge and defining an exterior face, a width extension, said width extension being defined respectively as that portion of said jambs, header or sill traversing the distance between said interior and exterior faces, said width extension having an inner side facing the interior of the area enclosed by said aperture frame and an oppositely facing outer side, a window mounting surface integrally formed on a portion of said width extensions, said window mounting surfaces having the area between them free of obstructing structure to facilitate mounting of a window, a storm shutter mounting structure integrally formed on each of said width extensions, each said storm shutter mounting structure being adapted for adjustable threaded engagement by shutter panel securing means and being positioned along a portion of said width extension between said exterior face and said window mounting surface;

an intermediate spacer integrally formed between the window mounting surface and the storm shutter mounting structure;

an imperforate high-strength, impact-resistant shield member and a mounting brace that frames the shield member, the mounting brace being received by said storm shutter mounting structure when the shutter is in the mounted position, the mounting brace having a substantially U-shaped cross-section including an edge member connecting two opposing lateral members, the edges of the shield member being received between the lateral members of the mounting brace; and an elongated nub positioned on the internal surface of each lateral member, substantially dividing each lateral member in half, the two nubs being diametrically opposed, each edge of the shield member resting on an adjacent pair of opposing nubs, said mounting brace including at least one hole extending through the mounting brace substantially perpendicular to the lateral members, the shutter mounting structure including a receiving aperture axially aligned with the hole in the mounting brace when the shutter is in a mounted position, and further including at least one fastener extending through the hole and into the receiving aperture to secure the shutter in a mounted position.

10. The system as recited in claim 1 wherein the header, sill, and jambs are further comprised of a plurality of support legs extending away from the outer side of said width extensions and capable of engaging side walls of said building aperture.

11. The system as recited in claim 1 further including a header bracket, the header bracket in cross section having two parallel and opposing lateral extensions and a header edge member connecting adjacent ends of the header lateral extensions, the header edge member and lateral extensions forming a "U"-shaped receiving channel, the header bracket securably receivable within the shutter mounting structure of the header so that the receiving channel faces the shutter mounting structure on the sill, a top of the mounting brace being receivable within the receiving channel.

* * * * *